US009956781B2

(12) United States Patent
Kobayashi

(10) Patent No.: US 9,956,781 B2
(45) Date of Patent: May 1, 2018

(54) MAINTENANCE MEMBER

(71) Applicant: BROTHER KOGYO KABUSHIKI KAISHA, Nagoya-shi, Aichi-ken (JP)

(72) Inventor: Haruo Kobayashi, Ichinomiya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days. days.

(21) Appl. No.: 15/366,382

(22) Filed: Dec. 1, 2016

(65) Prior Publication Data

US 2017/0157932 A1 Jun. 8, 2017

(30) Foreign Application Priority Data

Dec. 2, 2015 (JP) ..... 2015-236165

(51) Int. Cl.
*B41J 2/165* (2006.01)

(52) U.S. Cl.
CPC ..... *B41J 2/16517* (2013.01); *B41J 2/16538* (2013.01); *B41J 2/16541* (2013.01); *B41J 2/16544* (2013.01)

(58) Field of Classification Search
None
See application file for complete search history.

(56) References Cited

U.S. PATENT DOCUMENTS

| | | | |
|---|---|---|---|
| 5,798,775 A | 8/1998 | Takahashi et al. | |
| 6,082,848 A | 7/2000 | Taylor | |
| 6,575,553 B1 | 6/2003 | Williams et al. | |
| 2005/0151781 A1 | 7/2005 | Oku | |
| 2015/0042721 A1 | 2/2015 | Mano et al. | |
| 2016/0114585 A1* | 4/2016 | Kobayashi | B41J 2/16538 347/31 |

FOREIGN PATENT DOCUMENTS

| | | |
|---|---|---|
| CN | 101007464 A | 8/2007 |
| CN | 103101309 A | 5/2013 |
| EP | 0574268 A1 | 6/1993 |
| JP | 2011-056890 A | 3/2011 |
| JP | 2015-033784 A | 2/2015 |
| JP | 2016-083877 A | 5/2016 |

OTHER PUBLICATIONS

Extended European Search Report (EESR) dated May 29, 2017 issued in the corresponding European Patent Application No. 16201770.1.

Notification of First Office Action issued in connection with Chinese Patent Application No. 201611089391.4 dated Dec. 21, 2017. (16 pages).

* cited by examiner

*Primary Examiner* — Erica Lin
(74) *Attorney, Agent, or Firm* — K&L Gates LLP

(57) ABSTRACT

A maintenance member includes a plate, an absorption member, and a protection plate. The plate includes a first face and is configured to be mounted in a print device. The absorption member is fixed on the first face and has absorbed a liquid. The edge surface of the absorption member is exposed in an extension direction of the first face. The protection plate is fixed in place such that a gap is provided between the protection plate and the absorption member. The protection plate is configured to protect the absorption member from contact.

10 Claims, 25 Drawing Sheets

MAINTENANCE MEMBER

CROSS-REFERENCE TO RELATED APPLICATION

This application claims priority to Japanese Patent Application No. 2015-236165 filed Dec. 2, 2015. The contents of the foregoing applications are hereby incorporated herein by reference.

BACKGROUND

The present disclosure relates to a maintenance member that is configured to anchor to a plate an absorption member that absorbs ink.

An inkjet printer is known that is provided with a wiper and a liquid recovery part. The wiper removes a liquid, such as an ink or the like, from a nozzle forming surface on which a nozzle is formed. The liquid recovery part recovers the liquid, such as an ink or the like, that has been scraped off by the wiper. For example, an inkjet printer is known that is provided with a liquid jet part, a wiper and a liquid recovery part. The liquid jet part includes a liquid jet head and a carriage. The liquid jet head includes a nozzle forming surface in which a nozzle is formed. The carriage holds the liquid jet head. The wiper comes into contact with the nozzle forming surface and wipes off the ink that has adhered to the nozzle forming surface. The liquid recovery part is provided with a scraper part and a liquid absorption material. The scraper part comes into contact with the wiper and scrapes off the ink that has adhered to the wiper. The liquid absorption material is disposed in a position where it is not in contact with the wiper but is in contact with an edge portion of a scraping surface. The scraping surface scrapes off the ink that has adhered to the wiper. In the process, the ink adheres to the scraping surface. The liquid absorption material absorbs from the edge portion of the scraping surface the ink that has adhered to the scraping surface.

SUMMARY

In the inkjet printer that is described above, the liquid absorption material of the liquid recovery part may be made to absorb a moisturizing liquid or the like in advance, in order to inhibit the ink that the liquid absorption material has absorbed from returning to the wiper. In a case where the liquid recovery part is removable, the liquid recovery part can be replaced. A liquid such as the moisturizing liquid or the like can be inhibited from evaporating from the liquid absorption material of the replacement liquid recovery part by packaging the replacement liquid recovery part in a bag. When an operator or the like seizes the replacement liquid recovery part that is packaged in a bag, or when the operator or the like vacuum packs the bag that contains the liquid recovery part, for example, external pressure presses on the liquid recovery part from outside the bag. At this time, there is a possibility that a liquid such as the moisturizing liquid or the like will seep out of the liquid absorption material.

Embodiments of the broad principles derived herein provide a maintenance member that may reduce the possibility that a liquid will seep out of a liquid absorption material that absorbs a liquid.

The embodiments herein provide a maintenance member that includes a plate, an absorption member, and a protection plate. The plate includes a first face. The plate is configured to be mounted in a print device. The print device is configured to recover ink adhering to a wiper. The wiper is configured to wipe off ink adhering to a nozzle formation face of a print head. The print head is configured to discharge ink. The absorption member is fixed on the first face and has absorbed a liquid. The edge surface of the absorption member is exposed in an extension direction of the first face. The protection plate is fixed in place such that a gap is provided between the protection plate and the absorption member. The protection plate is configured to protect the absorption member from contact.

The embodiments herein also provide a maintenance member that includes a plate, an absorption member, a plate edge, opening edge portions, and a protection plate. The plate includes a first face and a second face disposed on the opposite side from the first face. The absorption member is configured to absorb ink. The absorption member includes an opposite face and an exposed face. The opposite face opposes the first face. The exposed face is disposed on the opposite side from the opposite face. The absorption member is disposed on the first face and has absorbed a liquid. The plate edge is located in a thickness direction from the exposed face. The thickness direction is the direction from the first face toward the second face. The plate edge is an edge of the plate on the side of the plate in an extension direction of the first face. The opening edge portions are located in the plate and opening toward the absorption member from the second face. The protection plate is fixed in place such that a gap is provided between the protection plate and the absorption member. The protection plate is configured to protect the absorption member from contact.

BRIEF DESCRIPTION OF THE DRAWINGS

Embodiments will be described below in detail with reference to the accompanying drawings in which.

DETAILED DESCRIPTION

Figure 1:
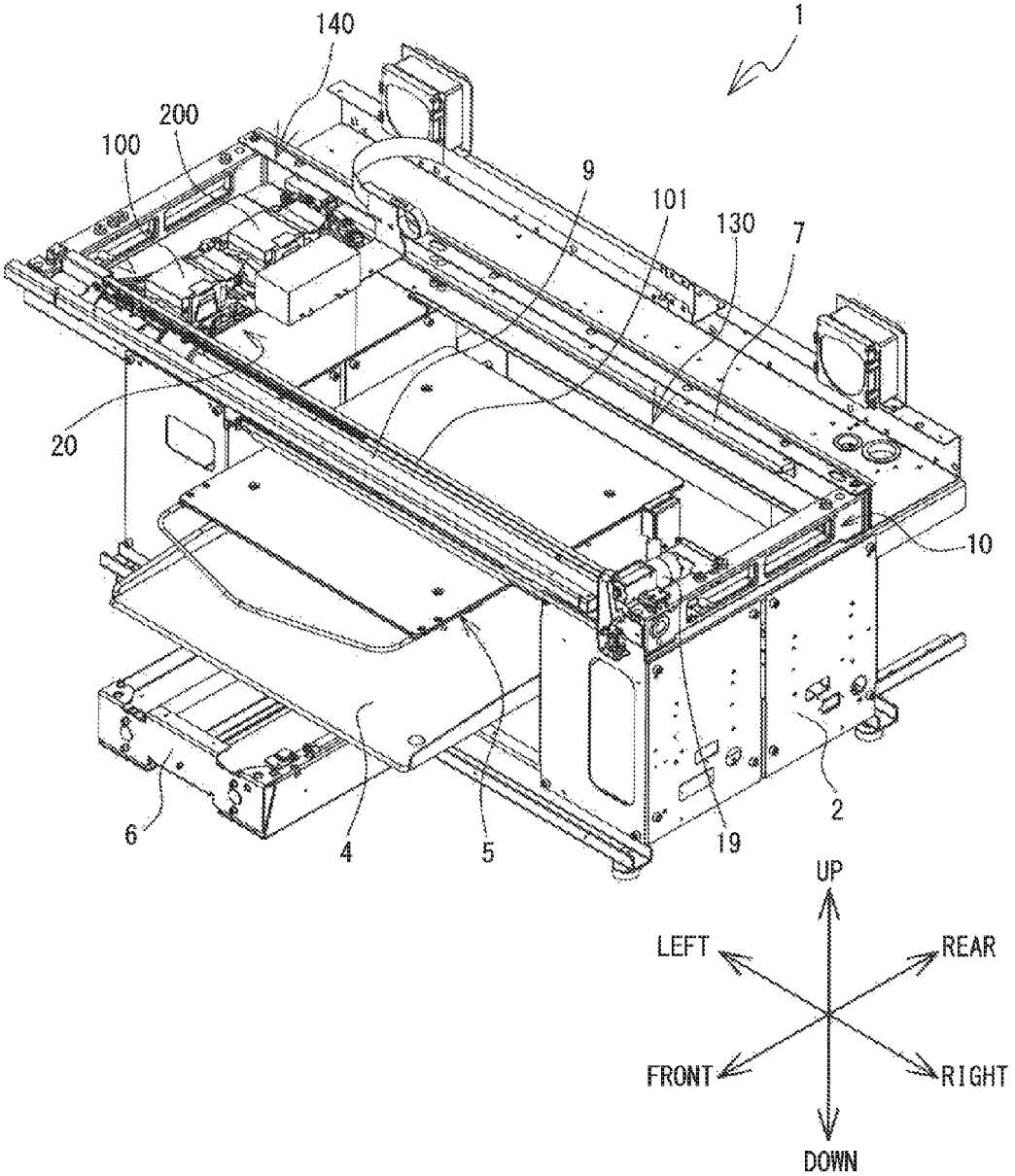
FIG. 1 is an oblique view of a printer.

The configuration of a printer 1 will be explained with reference to FIGS. 1 to 8. In the explanation that follows, the terms left, right, front, rear, up, and down that are used are those indicated by the arrows in the drawings.

As shown in FIG. 1, the printer 1 is an inkjet printer that prints by discharging an ink that is an example of a liquid onto a cloth such as a T-shirt or the like (not shown in the drawings) that is a printing medium. The printing medium may also be a paper or the like. The printer 1 is configured to print a color image on the printing medium by discharging downward five different types of the ink (white, black, yellow, cyan, and magenta), for example. In the explanation that follows, among the five different types of the ink, the ink that is white will be called the white ink. The other four types of the ink, black, yellow, cyan, and magenta, will be collectively called the color inks.

The printer 1 is provided with a housing 2, a platen drive mechanism 6, a pair of guide rails (not shown in the drawings), a platen 5, a tray 4, a frame body 10, a shaft 9, a rail 7, a carriage 20, head units 100, 200, a drive belt 101, and a drive motor 19.

An operation portion (not shown in the drawings) that performs operations of the printer 1 is disposed on the front side of the right portion of the housing 2. The operation portion is provided with a display and operation buttons. An operator operates the operation buttons when inputting commands that are related to various types of operations of the printer 1.

The frame body 10 has a frame shape that is substantially rectangular in a plan view, and it is installed in the top portion of the housing 2. The front side of the frame body 10 supports the shaft 9. The rear side of the frame body 10 supports the rail 7. The shaft 9 extends in the left-right direction on the inner side of the frame body 10. The rail 7 is disposed opposite the guide shaft 9 and extends in the left-right direction.

Figure 2:
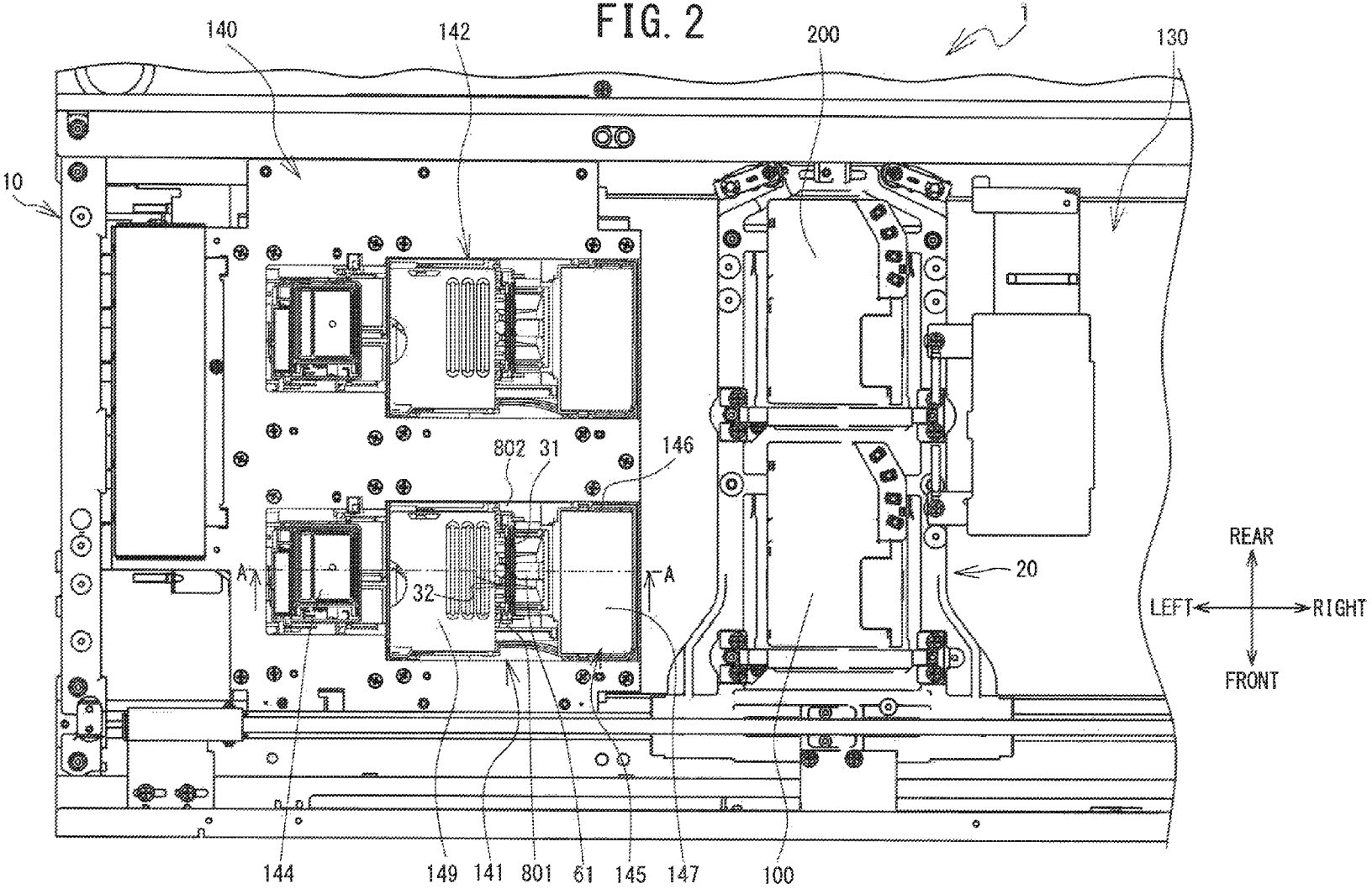
FIG. 2 is a plan view of the printer.
Figure 3:
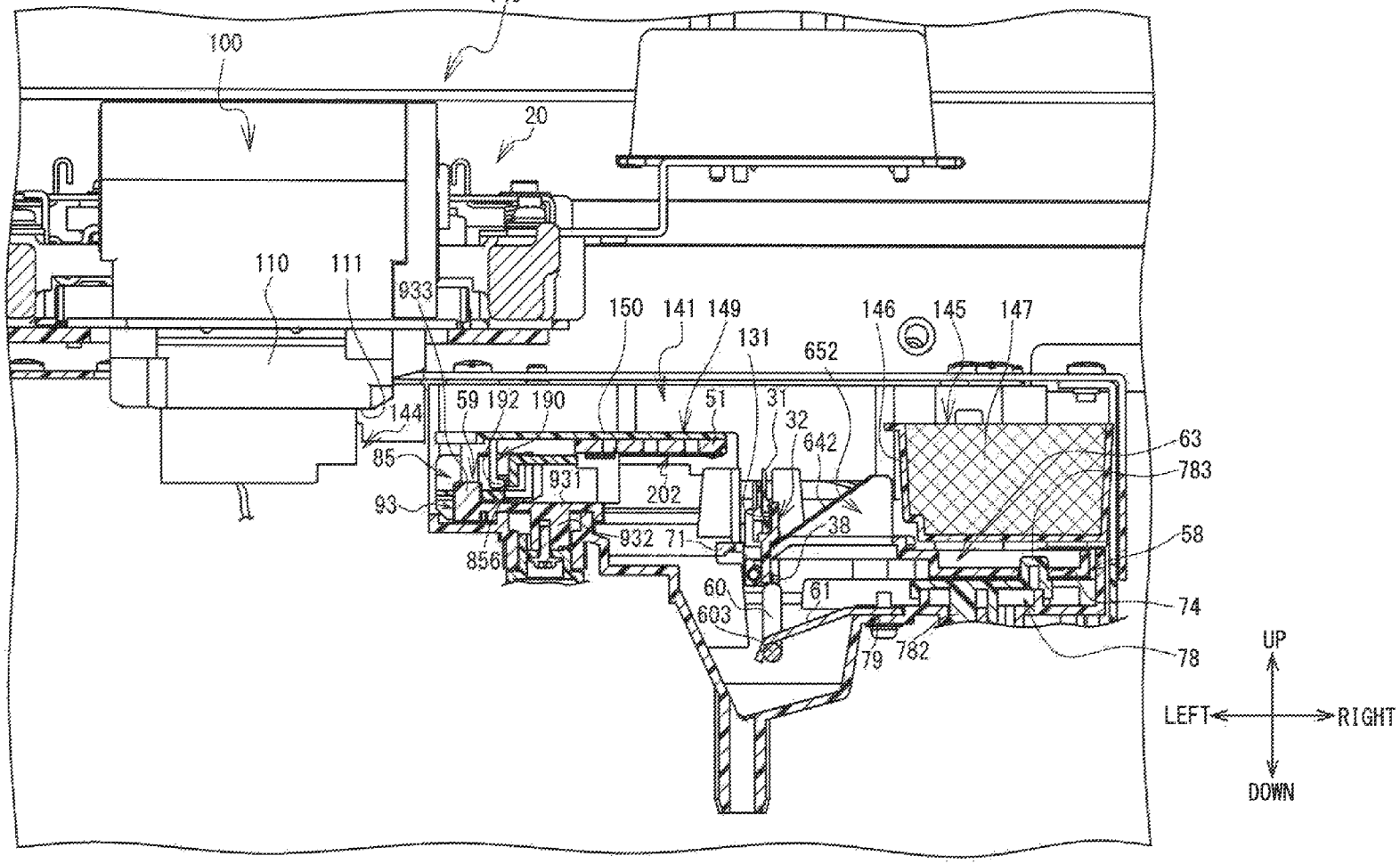
FIG. 3 is a section view, as seen from the direction of arrows A-A in FIG. 2, in which a wiper is in a withdrawn position and an absorption member is in a first position.

The carriage 20 is configured to be conveyed to the left and the right along the shaft 9. As shown in FIGS. 1 and 2, the head units 100, 200 are carried on the carriage 20. The head unit 100 is disposed in front of the head unit 200. As shown in FIG. 3, a head 110 is disposed on the bottom of each one of the head units 100, 200. A nozzle face 111 is disposed on the bottom face of the each of the heads 110. The nozzle face 111 is flat and parallel to the horizontal plane. FIG. 3 shows the head 110 and the nozzle face 111 on the head unit 100. A plurality of nozzles are disposed in the nozzle face 111 that are configured to discharge one of the white ink and the color inks downward.

As shown in FIG. 1, the drive belt 101 spans the inner side of the frame body 10 in the left-right direction. The drive motor 19 is provided in the front right portion of the inner side of the frame body 10. The drive motor 19 is coupled to the carriage 20 through the drive belt 101. As the drive motor 19 drives the drive belt 101, the carriage 20 moves reciprocally in the left-right direction (a main scanning direction) along the guide shaft 9. As the head units 100, 200 thus move reciprocally in the left-right direction, on the bottom sides of the head units 100, 200, the inks are discharged toward the platen 5, which is disposed such that it faces the head units 100, 200.

The platen drive mechanism 6 is provided with the pair of the guide rails (not shown in the drawings) and a platen support base (not shown in the drawings). The pair of the guide rails extend in the front-rear direction on the inner side of the platen drive mechanism 6. The pair of the guide rails support the platen support base such that it can move toward the front and the rear. The top portion of the platen support base supports the platen 5. The platen 5 supports the printing medium.

The tray 4 is disposed below the platen 5. In a case where the printing medium is a T-shirt, for example, the tray 4 receives the sleeves and the like of the T-shirt when the operator places the T-shirt on the platen 5. The tray 4 thus protects sleeves and the like, such that they do not come into contact with other parts in the interior of the housing 2.

An auxiliary scanning direction drive portion (not shown in the drawings) drives the platen drive mechanism 6. When the platen drive mechanism 6 is thus driven, it moves the platen support base and the platen 5 toward the front and the rear of the housing 2 along the pair of the guide rails. As the platen 5 conveys the printing medium in the front-rear direction (an auxiliary scanning direction), the heads 110 discharge the inks as they move reciprocally in the left-right direction. The printer 1 thus performs printing on the printing medium.

As shown in FIGS. 1 and 2, along the path that the heads 110 travel, the area where the heads 110 perform printing will be called the printing area 130. The area along the path that the heads 110 travel that is outside the printing area 130 will be called the non-printing area 140. The non-printing area 140 is an area in the left portion of the printer 1. The printing area 130 is the area from the right edge of the non-printing area 140 to the right end of the printer 1. The platen 5, the tray 4, and the like are disposed in the printing area 130.

Various types of maintenance operations for ensuring printing quality are performed in the non-printing area 140. For example, the maintenance operations include a flushing operation, an ink purge operation, a nozzle face wiping operation, a wiper wiping operation, and the like. The flushing operation is an operation that, before printing is performed on the printing medium, discharges the inks from the heads 110 onto a flushing receiving portion 145 (refer to FIG. 2) that will be described later. The flushing operation makes it possible for the inks to be discharged appropriately from the heads 110, even right after the printing starts. The ink purge operation is an operation in which the nozzle faces 111 are capped by nozzle caps 144 (refer to FIG. 2) that will be described later and the inks are pulled out of the nozzles by suction devices (not shown in the drawings) that are connected to the nozzle caps 144. The ink purge operation discharges, along with the ink, any air bubbles that have gotten inside the nozzles, for example. It is therefore possible to decrease the possibility that the air bubbles will cause an ink discharge problem to occur.

Figure 6:
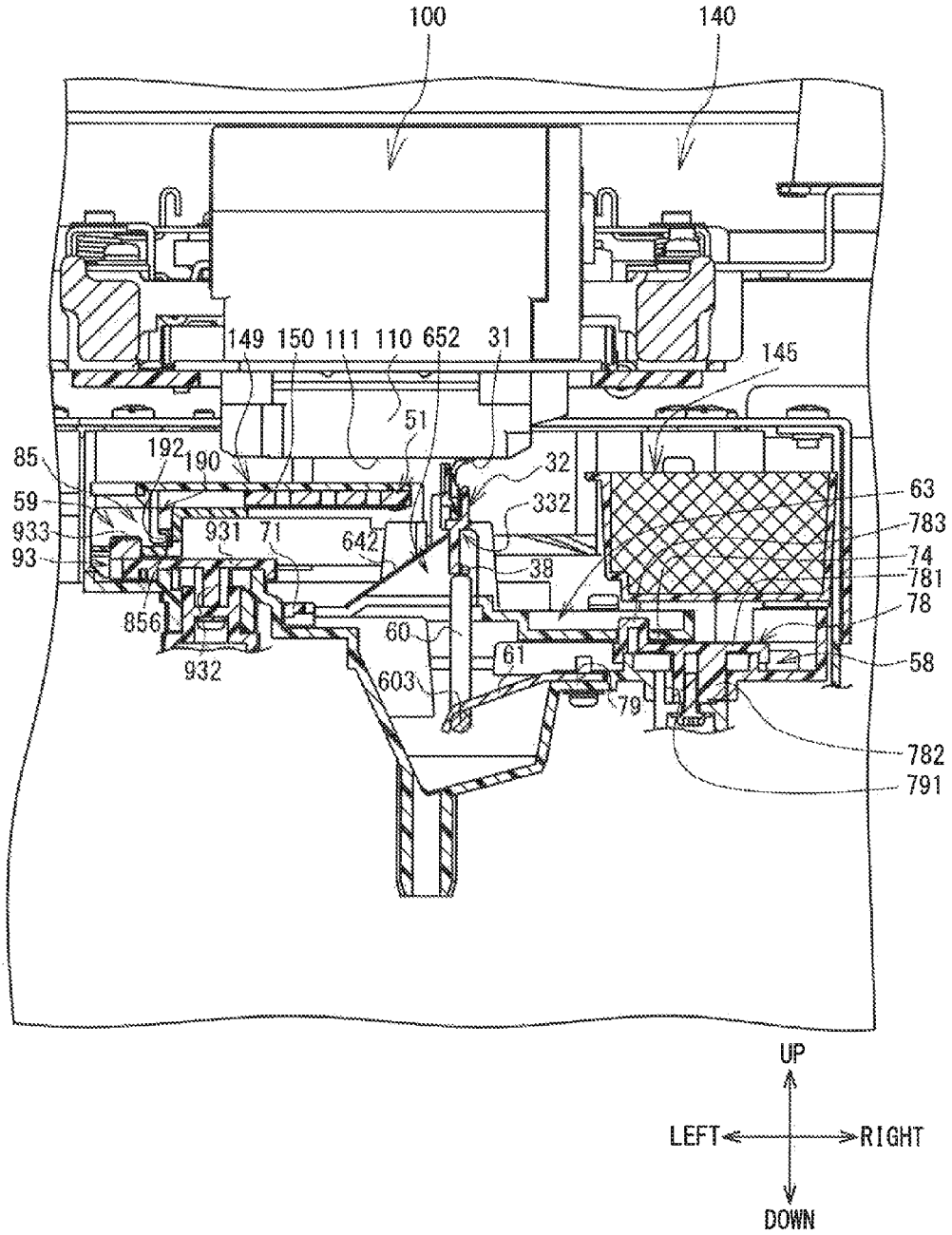
FIG. 6 is a section view of the printer in which the wiper is in a first contact position and a nozzle face wiping operation is performed.

The nozzle face wiping operation is an operation in which wipers 31 wipe off excess ink that is remaining on the surfaces of the nozzle faces 111 (refer to FIG. 6). When the ink that is remaining on nozzle faces 111 hardens and binds to the nozzle faces 111, there is a possibility that it will become difficult for the nozzles to discharge the inks. That possibility can be decreased by the nozzle face wiping operation. The wiper wiping operation is an operation in which absorption members 51 (refer to FIG. 3) that will be described later wipe off ink that is adhering to the wipers 31. In a state in which the ink that has been wiped off of the nozzle faces 111 is adhering to the wipers 31, there is a possibility that the ink from the wipers 31 will adhere to the nozzle faces 111 the next time that the nozzle face wiping operation is performed. That possibility can be decreased by the wiper wiping operation.

As shown in FIG. 2, maintenance mechanisms 141, 142 are disposed in the non-printing area 140. The maintenance mechanisms 141, 142 are positioned below the travel paths of the head units 100, 200, respectively. The maintenance mechanisms 141, 142 perform the maintenance operations on the head units 100, 200 under the control of a CPU (not shown in the drawings) of the printer 1. The configurations of the maintenance mechanisms 141, 142 are the same. Accordingly, in the explanation that follows, the maintenance mechanism 141 will be explained.

Figure 9:
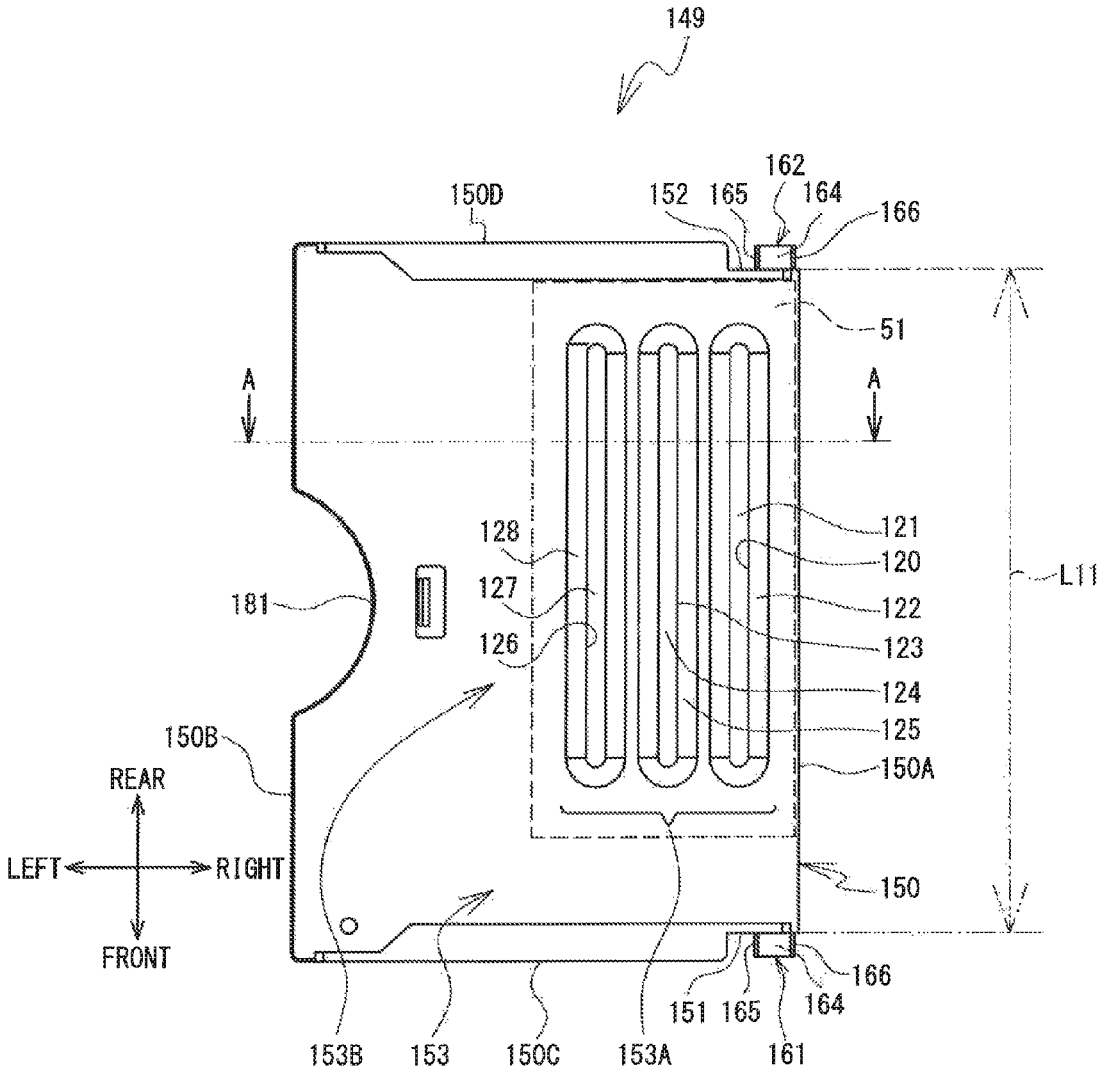
FIG. 9 is a plan view of the maintenance member.
Figure 10:
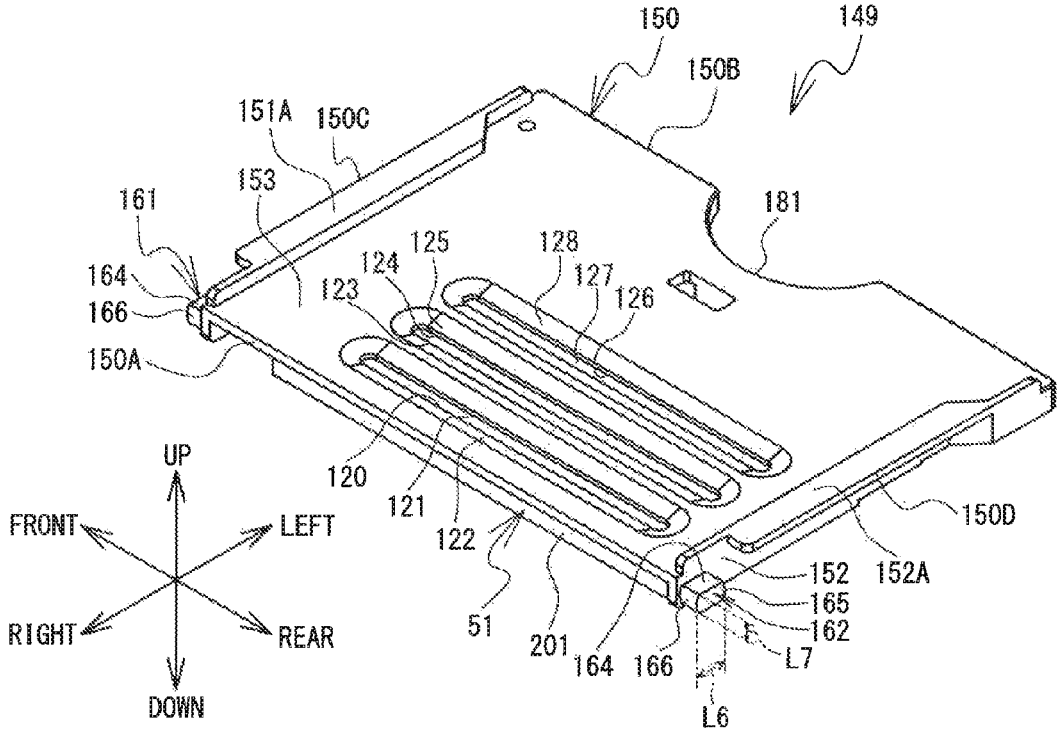
FIG. 10 is an oblique view of the maintenance member, as seen obliquely from above.
Figure 13:
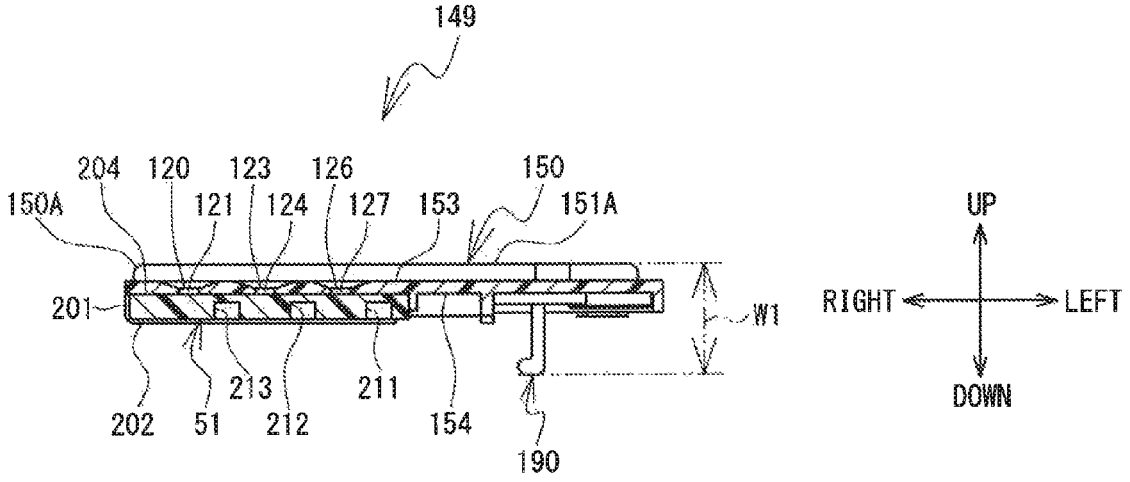
FIG. 13 is a section view of the maintenance member, as seen from the direction of arrows A-A in FIG. 9.

As shown in FIGS. 2 and 3, the maintenance mechanism 141 is provided with the wiper 31, the nozzle cap 144, the flushing receiving portion 145, and a maintenance member 149. The section views in FIGS. 3, 4, and 6 do not show opening edge portions 120, 123, 126, which will be described later, that are disposed in an upper plate 150 of the maintenance member 149. As shown in FIGS. 9 and 10, the opening edge portions 120, 123, 126 are disposed in the upper plate 150. In the section views in FIGS. 3, 4, and 6, slots 211 to 213 that are disposed in the absorption member 51 are through-holes (refer to FIG. 7). The slots 211 to 213 may also be slots that have bottoms, as shown in FIG. 13. The slots 211 to 213 may also be omitted from the absorption member 51. The nozzle cap 144 is provided in the left portion of the maintenance mechanism 141. The nozzle cap 144 is a cap that is rectangular in a plan view and is open at the top. The nozzle cap 144 is configured to move up and down. In a state in which the head unit 100 has moved over the nozzle cap 144, the nozzle cap 144 moves upward and covers the nozzle face 111. In this state, the ink purge operation is performed for the head unit 100. The ink that has accumulated in the nozzle cap 144 is thus discharged into a tank (not shown in the drawings) through a discharge channel that is not shown in the drawings.

As shown in FIG. 3, the flushing receiving portion 145 is positioned in the right part of the maintenance mechanism 141 and above a wall portion 74 (refer to FIG. 3) of a moving portion 63 that will be described later. The flushing receiving portion 145 is provided with a container portion 146 and a sponge 147. The container portion 146 is a container that is rectangular in a plan view and is open at the top. The sponge 147 is disposed inside the container portion 146 and is a three-dimensional rectangular member that is configured to absorb the ink. The flushing receiving portion 145 receives the ink that has been discharged from the head unit 100 by the flushing operation. The ink is absorbed by the sponge 147.

As shown in FIGS. 2 and 3, the wiper 31 is disposed to the left of the flushing receiving portion 145. The wiper 31 is configured to move up and down. In a state in which the wiper 31 has moved to its highest position, the moving of the carriage 20 in the left-right direction causes the wiper 31 to slide along the nozzle face 111. The wiper 31 thus removes the ink from the nozzle face 111 (refer to FIG. 6). In other words, the maintenance mechanism 141 performs the nozzle face wiping operation.

The maintenance member 149 is disposed between the wiper 31 and the nozzle cap 144 in the left-right direction. The maintenance member 149 supports the absorption member 51.

Figure 4:
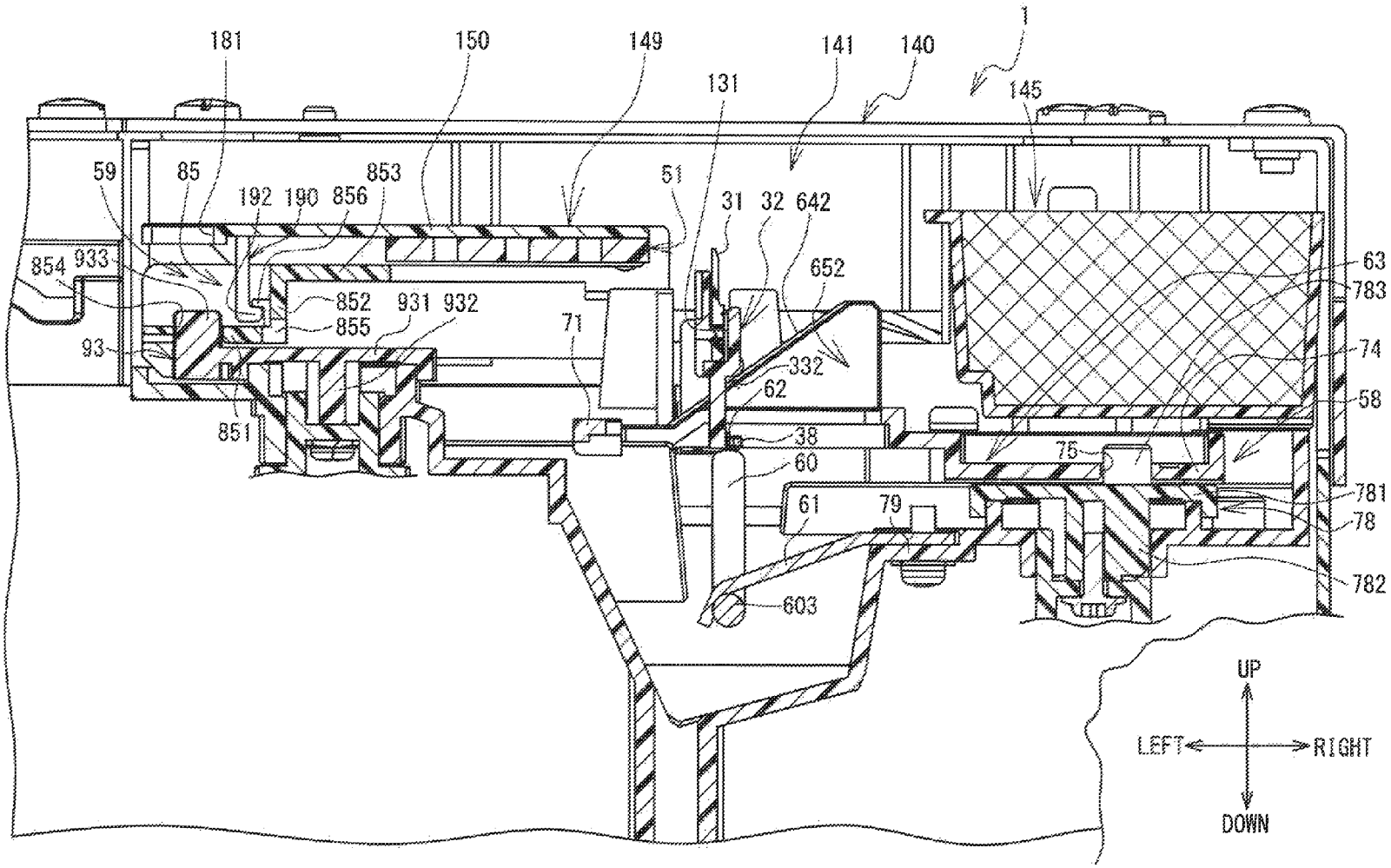
FIG. 4 is a section view of the printer 1 in which the wiper is in a second contact position and the absorption member is in the first position.
Figure 5:
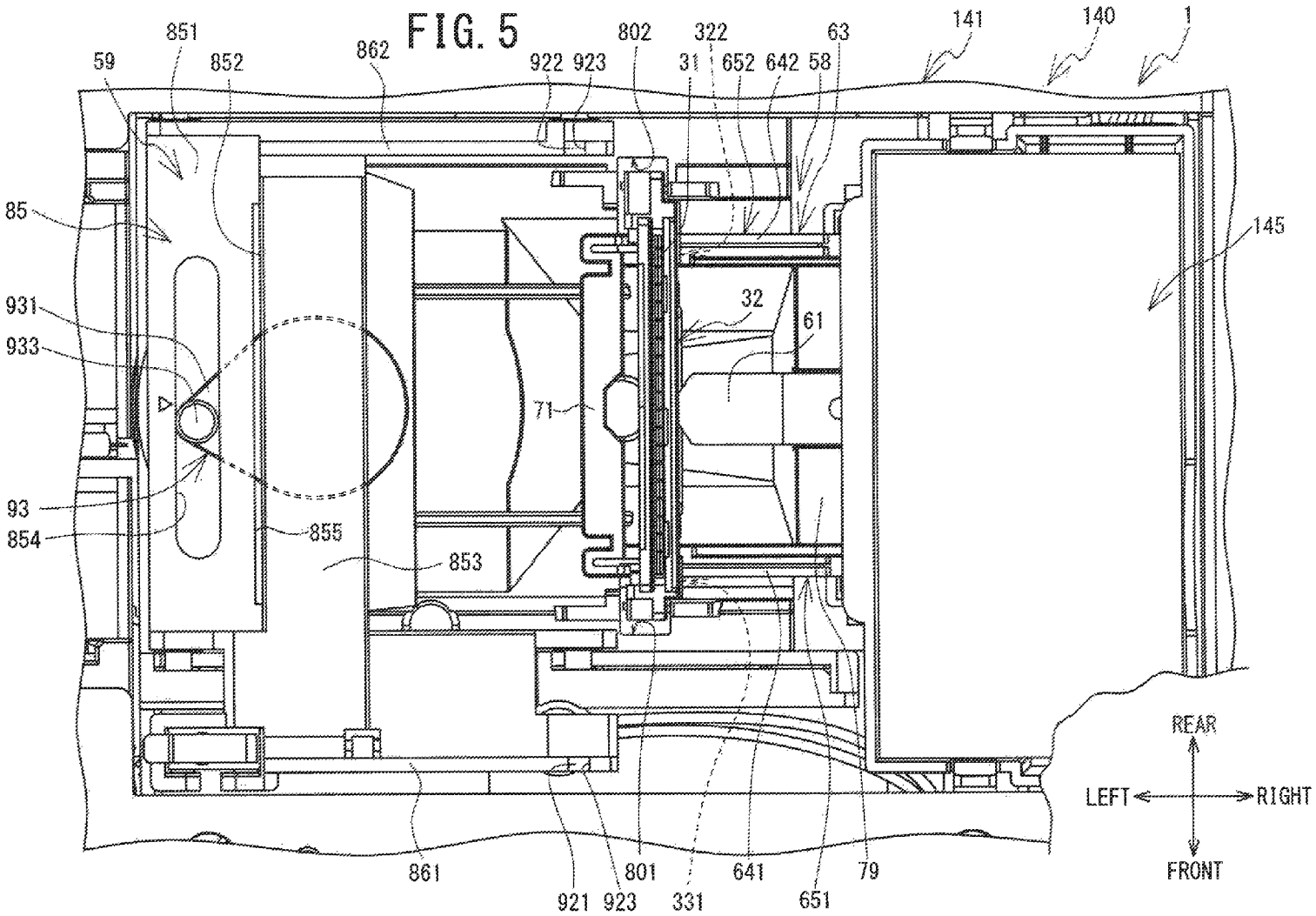
FIG. 5 is a plan view of a maintenance mechanism, from which a maintenance member has been removed.

The configuration that supports the wiper 31 and moves it up and down will be explained. As shown in FIGS. 3 to 5, the wiper 31, a wiper support portion 32, a second spring support portion 61 (refer to FIG. 3), guide wall portions 801, 802 (refer to FIG. 5), and a wiper drive mechanism 58 are disposed in the non-printing area 140. As shown in FIG. 3, the wiper 31 extends in the front-rear direction. The top edge of the wiper 31 is parallel to the nozzle face 111. The wiper support portion 32 is disposed on the bottom side of the wiper 31 and supports the wiper 31. When viewed from the left side, the wiper support portion 32 is formed into a rectangle whose long axis extends in the front-rear direction, and it has a specified width in the left-right direction (refer to FIG. 5). As shown in FIGS. 3 and 4, the wiper support portion 32 is provided with a recessed portion 131 that is recessed downward. The lower portion of the wiper 31 is disposed inside the recessed portion 131.

As shown in FIGS. 4 and 5, engagement portions 331, 332 are disposed on the bottom edges of the front and rear ends, respectively, of the wiper support portion 32. The engagement portions 331, 332 each have a recessed portion that is recessed upward, and inclined portions 641, 642, which will be described later, are disposed inside the respective recessed portions. The engagement portions 331, 332 engage with the inclined portions 641, 642, respectively, such that they can move in relation to the inclined portions 641, 642.

As shown in FIG. 4, a pair of first spring support portions 38 that are set apart from one another in the front-rear direction are disposed on the bottom edge of the wiper support portion 32. The pair of the first spring support portions 38 are hook-shaped and extend to the outside in the front-rear direction. The first spring support portions 38 support spring end portions 62 that are opposite ends of a single coil spring 60. The spring end portions 62 are formed into ring shapes, and they are hooked onto the hook-shaped first spring support portions 38. Of the pair of the first spring support portions 38, FIG. 4 shows the first spring support portion 38 on the rear side and also shows the spring end portion 62 on the rear side, which is hooked onto the first spring support portion 38 on the rear side.

As shown in FIGS. 4 and 5, the second spring support portion 61 is positioned below the wiper support portion 32 in the up-down direction and between the pair of the first spring support portions 38 in the front-rear direction. A wall portion 79 supports the right end of the second spring support portion 61. The second spring support portion 61 is a metal plate that extends downward toward the left from the right end that is supported by the wall portion 79, and its tip is bent downward. As shown in FIG. 4, the pair of the first spring support portions 38 support both ends of the coil spring 60. In a state in which the coil spring 60 is pulled downward, a central portion 603 of the coil spring 60 is hooked by the bottom face of the second spring support portion 61. Thus, in a left side view, the coil spring 60 assumes a V shape in which the central portion 603 is recessed downward. When the coil spring 60 is supported by the pair of the first spring support portions 38 and the second spring support portion 61, its resilience energizes the wiper support portion 32 downward. The coil spring 60 thus energizes the wiper 31 downward. The wiper support portion 32 moves up and down along the guide wall portions 801, 802 (refer to FIG. 5) in conjunction with the movements of the moving portion 63 in the left-right direction.

As shown in FIG. 5, the guide wall portions 801, 802 each extend in the up-down direction and are disposed along the contours of the front and rear edges of the wiper support portion 32 in a plan view. The guide wall portion 801 is provided with a pair of wall faces that face the left and right sides of the front end of the wiper support portion 32. The guide wall portion 802 is provided with a pair of wall faces that face the left and right sides of the rear end of the wiper support portion 32. Therefore, the guide wall portions 801, 802 may restrict the movement of the wiper support portion 32 in the left-right direction. The guide wall portions 801, 802 guide the up-down movements of the wiper 31 and the wiper support portion 32, specifically guiding them among a first contact position (refer to FIG. 6), a second contact position (refer to FIG. 4), and a withdrawn position (refer to FIG. 3).

As shown in FIG. 6, the first contact position is a position of the wiper 31 and the wiper support portion 32 in which the wiper 31 is able to be in contact with the nozzle face 111. In the first contact position, the wiper support portion 32 is engaged with the upper ends of the inclined portions 641, 642 (described later). As shown in FIG. 4, the second contact position is a position of the wiper 31 and the wiper support portion 32 in which the wiper 31 is able to be in contact with the absorption member 51. In the second contact position, the wiper support portion 32 is engaged with the inclined portions 641, 642 (described later) slightly below their centers in the up-down direction. As shown in FIG. 3, the withdrawn position is a position of the wiper 31 and the wiper support portion 32 in which the wiper 31 has withdrawn from both the nozzle face 111 and the absorption member 51. In the withdrawn position, the wiper support portion 32 is engaged with the lower ends of the inclined portions 641, 642 (described later).

The wiper drive mechanism 58 will be explained. The wiper drive mechanism 58 is a mechanism that moves the wiper 31 and the wiper support portion 32 up and down. As shown in FIG. 4, the wiper drive mechanism 58 includes the moving portion 63 and a rotating member 78.

As shown in FIGS. 4 and 5, the moving portion 63 is provided with a pair of opposite wall portions 651, 652 and the wall portion 74. The pair of the opposite wall portions 651, 652 face one another in the front-rear direction and are substantially triangular in a side view. The opposite wall portions 651, 652 are respectively provided with the inclined portions 641, 642.

The pair of the inclined portions 641, 642 are disposed on the upper parts of the opposite wall portions 651, 652, respectively, and are components that extend obliquely downward toward the left. The inclined portions 641, 642 move the wiper 31 and the wiper support portion 32 in the up-down direction in conjunction with the movements of the moving portion 63 in the left-right direction.

An extension portion 71 spans the gap between the lower ends of the inclined portions 641, 642. The extension portion 71 is plate-shaped and parallel to the horizontal plane. As shown in FIG. 4, the wall portion 74 is a wall portion that is rectangular in a plan view. The left parts of both the front and the rear edges of the wall portion 74 are connected to the lower parts of the right edges of the opposite wall portions 651, 652, respectively. An oblong hole 75 is disposed in the right part of the wall portion 74. In a plan view, the oblong hole 75 has the same shape as an oblong hole 854 (refer to FIG. 5) that will be described later. The oblong hole 75 passes through the wall portion 74 in the up-down direction, with its long axis extending in the front-rear direction.

The moving portion 63 moves in the left-right direction in conjunction with the rotation of the rotating member 78. The rotating member 78 is positioned below the wall portion 74. The rotating member 78 is rotated by the operation of a drive portion (not shown in the drawings) that will be described later. The rotating member 78 is provided with a rotating wall portion 781, a drive shaft 782, and a shaft portion 783. The rotating wall portion 781 is a wall portion that faces the wall portion 74 from below the wall portion 74. The rotating wall portion 781 is circular in a plan view. The drive shaft 782 extends in the up-down direction. The upper end of the drive shaft 782 is connected to the center of the bottom face of the rotating wall portion 781. The drive shaft 782 is connected to the drive portion (not shown in the drawings), which will be described later.

The shaft portion 783 extends in the up-down direction. The lower end of the shaft portion 783 is connected to the outer circumferential portion of the top face of the rotating wall portion 781. The shaft portion 783 is positioned to the outside of the rotational center of the drive shaft 782. The shaft portion 783 is inserted through the oblong hole 75 in the same manner that a shaft portion 933 (refer to FIG. 5) is inserted through the oblong hole 854 (refer to FIG. 5), which will be described later.

Figure 7:
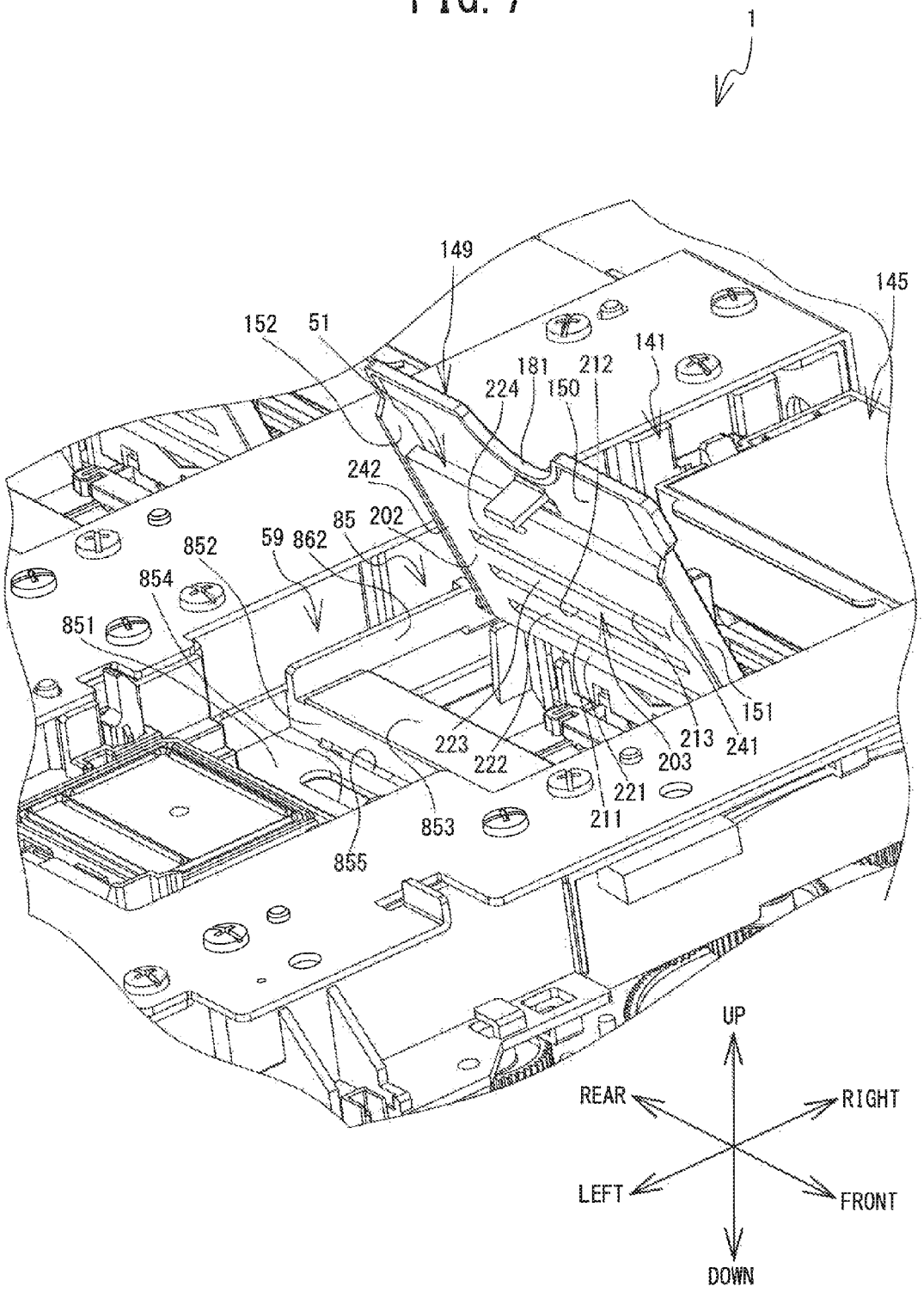
FIG. 7 is an oblique view of the maintenance mechanism, in which the maintenance member is in an inclined state.

The configuration that supports the absorption member 51 and moves it to the left and the right will be explained. In the explanation that follows, the front-rear direction in which the upper edge on the absorption member 51 side of the wiper 31 extends will sometimes simply be called the front-rear direction for the sake of convenience. In FIG. 7, the maintenance member 149 is in an inclined state, having rotated clockwise in a front view from a mounted orientation, which is the orientation of the maintenance member 149 that is shown in FIG. 4. The mounted orientation is an orientation in which the maintenance member 149 is parallel to the horizontal plane. The leftward direction and the rightward direction that are referenced when the maintenance member 149 as shown in FIG. 7 is explained are the same directions as when the maintenance member 149 is in the mounted orientation (refer to FIG. 4).

Structure of the Maintenance Member 149

As shown in FIG. 4, the maintenance member 149 and an absorption drive mechanism 59 are disposed in the non-printing area 140. As shown in FIGS. 7 to 12, the maintenance member 149 is provided with the upper plate 150, side walls 151, 152, the absorption member 51, engagement lugs 161, 162, and a locking projection portion 190. In a plan view, the upper plate 150 has a substantially rectangular plate shape that extends in the front-rear direction and the left-right direction. The upper plate 150 is provided with a right edge 150A, a left edge 150B, a front edge 150C, and a rear edge 150D. Hereinafter, the direction from the front edge 150C to the rear edge 150D will be called the front-rear direction. The direction from the left edge 150B to the right edge 150A will be called the left-right direction.

Figure 11:
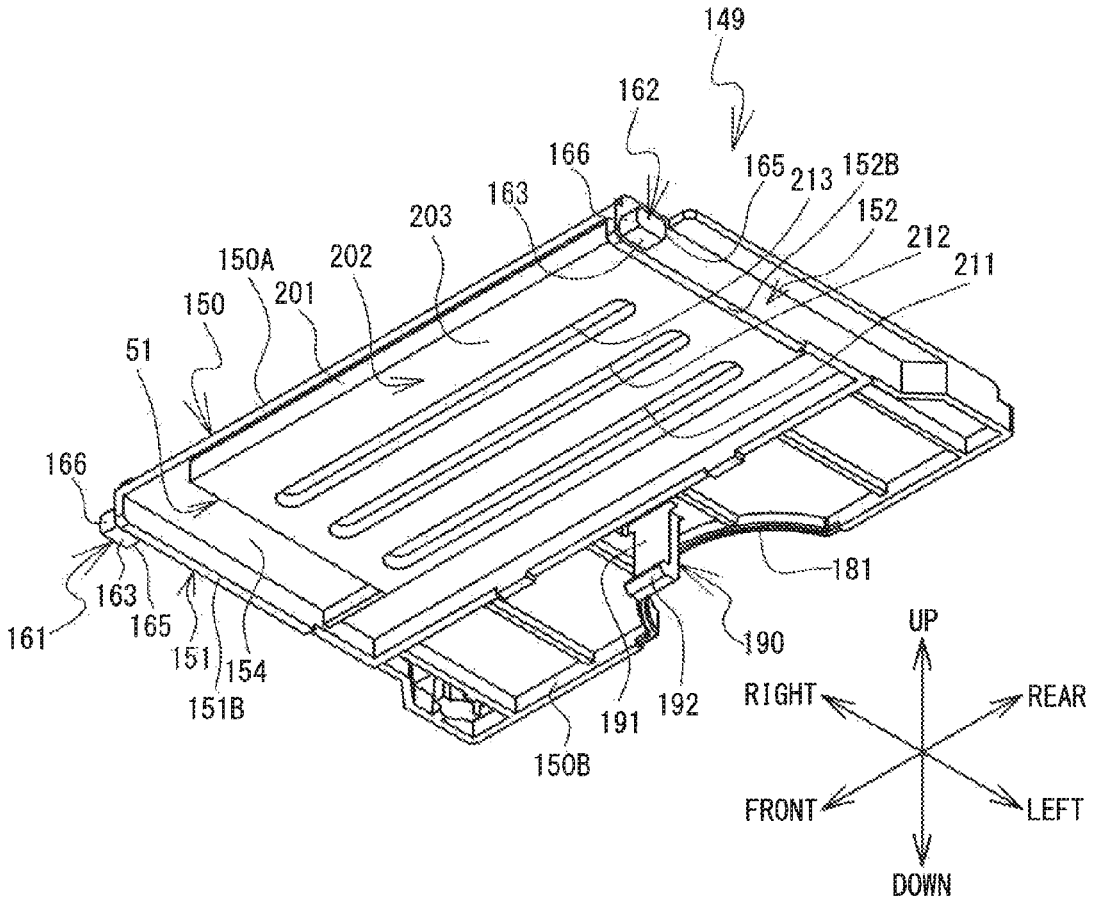
FIG. 11 is an oblique view of the maintenance member, as seen obliquely from below.

A recessed portion 181 that is recessed toward the right in a circular arc is provided in the left edge 150B. The side walls 151, 152 extend downward from the front and rear edges, respectively, of the upper plate 150. The side walls 151, 152 extend from slightly to the right of the left edge 150B of the upper plate 150 all the way to the right edge 150A of the upper plate 150. As shown in FIG. 11, the lower edges of the side walls 151, 152 respectively form first projection portions 151B, 152B, which project downward. As shown in FIG. 10, the upper edges of the side walls 151, 152 respectively form third projection portions 151A, 152A, which project upward. As shown in FIG. 11, the first projection portions 151B, 152B project farther than an absorption face 202 of the absorption member 51 in the up-down direction.

Figure 12:
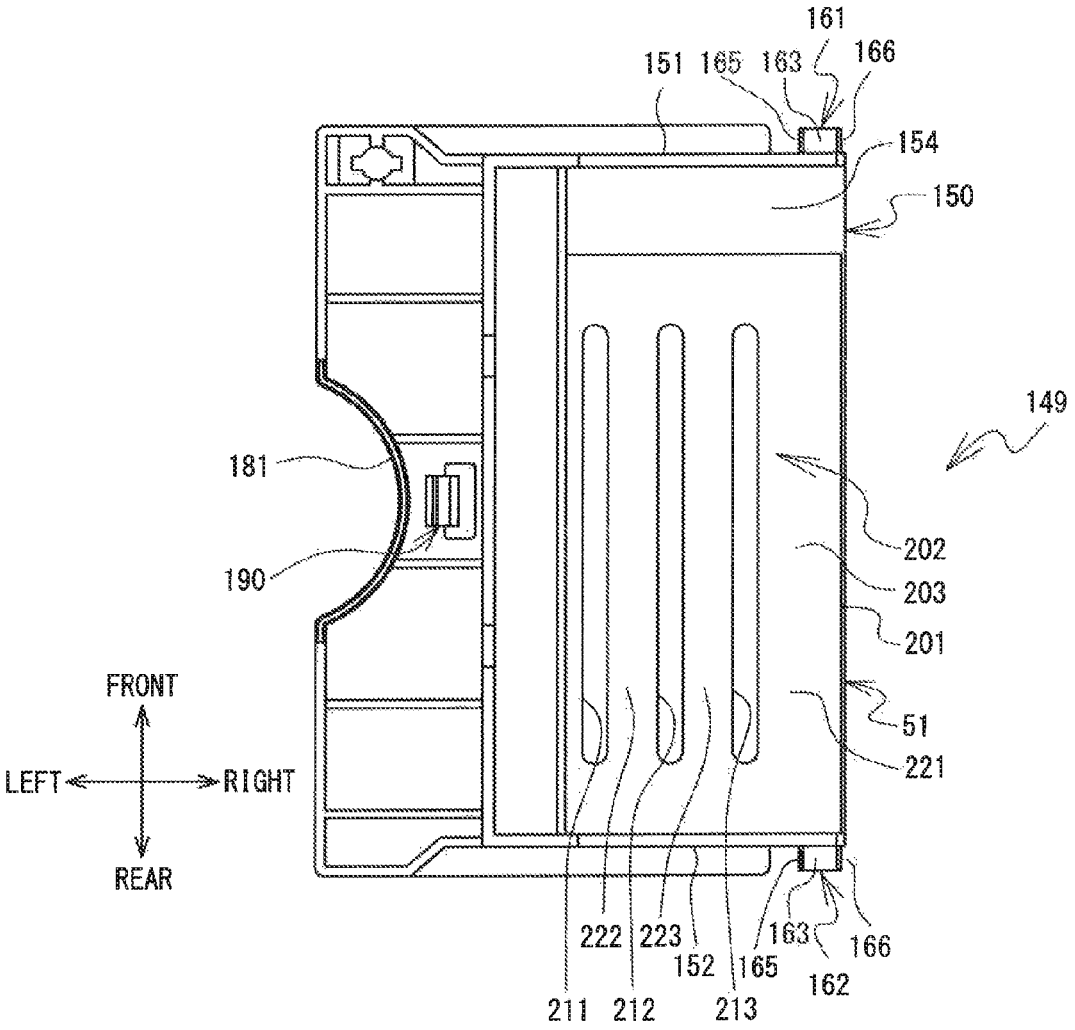
FIG. 12 is a bottom view of the maintenance member.

As shown in FIGS. 9 and 10, an upper face 153 is provided on the top side of the upper plate 150. As shown in FIGS. 11 and 12, a lower face 154 is provided on the bottom side of the upper plate 150. In a plan view, the upper face 153 and the lower face 154 are substantially rectangular faces that extend in the front-rear direction and the left-right direction of the upper plate 150. The color of the upper plate 150 may be gray, for example. Therefore, the color of the upper face 153 and the lower face 154 would also be gray.

An allocated area 153A and an unallocated area 153B are disposed on the upper face 153, adjacent to one another in the left-right direction. The opening edge portion 120, the opening edge portion 123, and the opening edge portion 126 are located in the allocated area 153A, arrayed in that order starting from the right edge 150A side. The unallocated area 153B is an area in which no opening edge portions are located. The allocated area 153A is the area of the upper plate 150 from the center in the left-right direction to the right edge 150A. The allocated area 153A is located toward an edge face 201 side of the absorption member 51, which will be described later, from the center of the upper plate 150 in the left-right direction. The unallocated area 153B is the area of the upper plate 150 from the center in the left-right direction to the left edge 150B. The absorption member 51 is disposed on the lower face 154. For example, the absorption member 51 is positioned on the lower face 154 side of the allocated area 153A and is not positioned on the lower face 154 side of the unallocated area 153B.

The opening edge portions 120, 123, 126 are provided such that they each extend in the front-rear direction of the upper plate 150. The ends of the opening edge portions 120, 123, 126 in the front-rear direction each have circular arc shapes. The opening edge portion 120 forms an opening 121. The opening edge portion 123 forms an opening 124. The opening edge portion 126 forms an opening 127. The openings 121, 124, 127 are oblong holes whose long axes extend in the front-rear direction. The openings 121, 124, 127 are open clear through from the upper face 153 to the lower face 154. Therefore, the openings 121, 124, 127 are open clear through from the upper face 153 toward the absorption member 51. The opening edge portions 120, 123, 126 are disposed such that they each extend in the front-rear direction. The upper plate 150 is provided with inclined portions 122, 125, 128 that respectively encircle the opening edge portions 120, 123, 126. The inclined portions 122, 125, 128 incline from the upper face 153 toward the lower face 154 as they extend toward the opening edge portions 120, 123, 126.

As shown in FIG. 10, the right edge 150A is the edge on the right side of the upper plate 150 in the left-right direction of the lower face 154. As shown in FIG. 13, in the thickness direction, the right edge 150A is positioned higher than the absorption face 202 of the absorption member 51, which will be described later. The thickness direction is the direction from the lower face 154 toward the upper face 153.

Structure of the Engagement Lugs 161, 162

Figure 14:
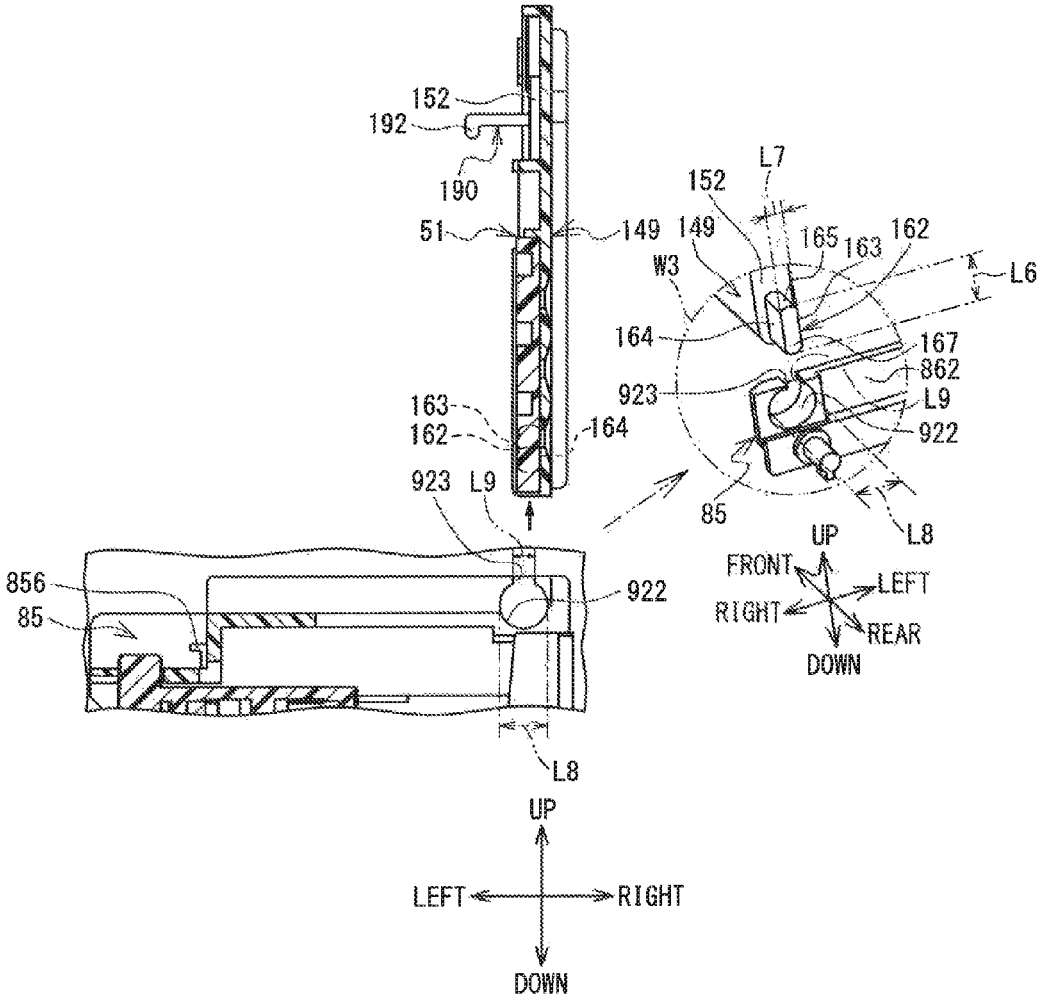
FIG. 14 is a figure for explaining mounting and removal of the maintenance member.

As shown in FIGS. 9 to 12, the engagement lugs 161, 162 are lugs that respectively project toward the front from the front edge of the maintenance member 149 and toward the rear from the rear edge of the maintenance member 149. The engagement lugs 161, 162 respectively project from the side walls 151, 152 on the right edge 150A side in the allocated area 153A. The engagement lugs 161, 162 can respectively be mounted in and removed from engagement slots 921, 922 that will be described later (refer to FIGS. 8 and 14). A distance L11 (refer to FIG. 9) is the same as a distance L12 (refer to FIG. 8). The distance L11 is the distance between the pair of the engagement lugs 161, 162 in the front-rear direction. The distance L12 is the distance between the pair of the engagement slots 921, 922 in the front-rear direction. Note that the assertion that the distances L11, L12 are the same allows for sufficient difference between the distances L11, L12 for the maintenance member 149 to open and close when the engagement slots 921, 922 are respectively holding the engagement lugs 161, 162 such that the engagement lugs 161, 162 can rotate. For example, when the distance L11 is slightly less than the distance L12, the distances L11, L12 are regarded as being the same. As shown in FIGS. 9, 10, and 14, the engagement lugs 161, 162 are each provided with flat faces 163, 164 and rounded faces 165, 166. As shown in FIG. 10, a length L6 of the engagement lugs 161, 162 is greater than a length L7 of the engagement lugs 161, 162. The length L6 is the length in left-right direction. The length L7 is the length in the up-down direction.

The flat faces 163, 164 of the engagement lugs 161, 162 are faces that are orthogonal to and connected with the side walls 151, 152, respectively, of the maintenance member 149. The flat faces 163, 164 are parallel to the absorption face 202 of the absorption member 51, which will be described later. The rounded faces 165, 166 are faces that are orthogonal to and connected with the side walls 151, 152, respectively, of the maintenance member 149. The rounded faces 165, 166 are connected to the edges of the corresponding flat faces 163, 164. The rounded faces 165, 166 of the engagement lugs 161, 162 have circular arc shapes that respectively conform to the shapes of the engagement slots 921, 922, which will be described later. In a state in which the maintenance member 149 is oriented parallel to the vertical direction, the flat faces 163, the flat faces 164, the rounded faces 165, and the rounded faces 166 are respectively formed on the left faces, the right faces, the upper faces, and the lower faces of the engagement lugs 161, 162. The state in which the maintenance member 149 is oriented parallel to the vertical direction is a state in which the left-right direction of the upper plate 150 is parallel to the vertical direction and the engagement lugs 161, 162 are positioned on the lower side of the upper plate 150 in the vertical direction. As shown in FIG. 14, the length L7 between the flat faces 163, 164 is shorter than a width L9 of an opening 923 in each of the engagement slots 921, 922. The length L6 between the rounded faces 165, 166 is longer than the width L9 of the opening 923 in each of the engagement slots 921, 922. The length L6 between the rounded faces 165, 166 is slightly shorter than a diameter L8 of each of the engagement slots 921, 922. Therefore, when the maintenance member 149 is in the mounted orientation, the engagement lugs 161, 162 do not come out of the engagement slots 921, 922.

Structure of the Locking Projection Portion 190

As shown in FIGS. 11 and 12, the locking projection portion 190 is a projection portion that is disposed in the unallocated area 153B and that projects downward, which is the direction from the lower face 154 toward the absorption member 51. As shown in FIG. 11, the locking projection portion 190 is provided with a plate portion 191 and a locking claw 192. The plate portion 191 is provided such that it extends downward from the lower face 154. The locking claw 192 is located on the tip of the plate portion 191. The locking claw 192 locks to a locking portion 856 (refer to FIG. 14). The maintenance member 149 is thus secured in a closed state, as shown in FIGS. 3 and 4.

The operator hooks a finger into the recessed portion 181 and pulls the recessed portion 181 upward. At this time, the engagement between the locking claw 192 and the locking portion 856 is released (refer to FIGS. 7 and 14). The maintenance member 149 rotates clockwise in a front view, with the engagement lugs 161, 162 that are positioned inside of the engagement slots 921, 922 serving as the axis of rotation. When the maintenance member 149 rotates, the rounded faces 165, 166 of the engagement lugs 161, 162 slide along the inner faces of the engagement slots 921, 922, respectively. The maintenance member 149 thus enters the state in which it is oriented parallel to the vertical direction, as shown ins FIG. 14.

In the state in which maintenance member 149 is oriented parallel to the vertical direction, the operator pulls the maintenance member 149 upward. The length L7 between the flat faces 163, 164 of each of the engagement lugs 161, 162 is shorter than the width L9 of the opening 923 in each of the engagement slots 921, 922. The engagement lugs 161, 162 come out of the respective engagement slots 921, 922 through the openings 923 in the engagement slots 921, 922, as shown in FIG. 14. The maintenance member 149 is thus removed from a mounting portion 85, which will be described later. The new maintenance member 149 is mounted in the mounting portion 85 by programming the steps described above in the reverse order.

Structure of the Absorption Member 51

As shown in FIGS. 7, 11, and 12, the absorption member 51 is affixed to the lower face 154 of the upper plate 150 of the maintenance member 149. The absorption member 51 has a substantially three-dimensional rectangular shape. The absorption member 51 is affixed to the lower face 154 side of the allocated area 153A (refer to FIG. 9), between the side walls 151, 152. The absorption member 51 is in contact with the side wall 152. A gap is provided between the absorption member 51 and the side wall 151. The absorption member 51 is formed from a material, such as a sponge, felt, or the like, that is configured to absorb a liquid. The absorption member 51 absorbs the ink that has adhered to the wiper 31.

As shown in FIGS. 11 and 12, the absorption member 51 is provided with the edge face 201, which is the rectangular right side face on the right edge of the absorption member 51. The absorption member 51 is provided with the absorption face 202, which is the bottom face of the three-dimensional rectangular absorption member 51, on the bottom side, facing the wiper 31. The absorption member 51 is provided with an affixing face 204 (refer to FIG. 13) on the top face of the absorption member 51, on the opposite side of the absorption member 51 from the absorption face 202. The absorption member 51 is affixed by bringing the affixing face 204 into contact with the lower face 154 of the upper plate 150. The edge face 201 is exposed on the right edge 150A side of the upper plate 150. That is, the edge face 201 of the absorption member 51 is provided on the right edge 150A side of the upper plate 150, such that the edge face 201 extends parallel to the right edge 150A and orthogonal to the lower face 154. The edge face 201 extends in the front-rear direction of the upper plate 150. The absorption member 51 is affixed in the position where it covers each of the opening edge portions 120, 123, 126 in the lower face 154. The absorption member 51 is moistened by a liquid such as a moisturizing solution, water, or the like.

The absorption face 202 may also be a flat face that extends in the front-rear and left-right directions. The absorption face 202 may also be provided with a plurality of grooves 211, 212, 213 that extend in the front-rear direction.

Absorption Drive Mechanism 59

As shown in FIGS. 5 and 7, the absorption drive mechanism 59 includes the mounting portion 85 and a rotating member 93. The maintenance member 149 is moved in the left-right direction by the operation of the absorption drive mechanism 59. The mounting portion 85 is a member on which the maintenance member 149 is mounted. The mounting portion 85 is provided with a first wall portion 851, a second wall portion 852, a third wall portion 853, and side walls 861, 862.

In a plan view, the first wall portion 851 is rectangular, with its long axis extending in the front-rear direction, and it is a wall portion that forms the left end portion of the mounting portion 85. The first wall portion 851 is provided with the oblong hole 854. The oblong hole 854 passes through the first wall portion 851 in the up-down direction, with its long axis extending in the front-rear direction. The shaft portion 933, which will be described later, is inserted through the oblong hole 854.

The second wall portion 852, which extends upward, is connected to the right edge of the first wall portion 851. A hole 855 whose long axis extends in the front-rear direction is disposed in the part where the first wall portion 851 and the second wall portion 852 are connected. The third wall portion 853 is connected to the upper edge of the second wall portion 852. The third wall portion 853 is rectangular in a plan view, with its long axis extending in the front-rear direction. The side walls 861, 862 extend upward from the front and rear edges, respectively, of the third wall portion 853, and they extend toward the right from the third wall portion 853.

Figure 8:
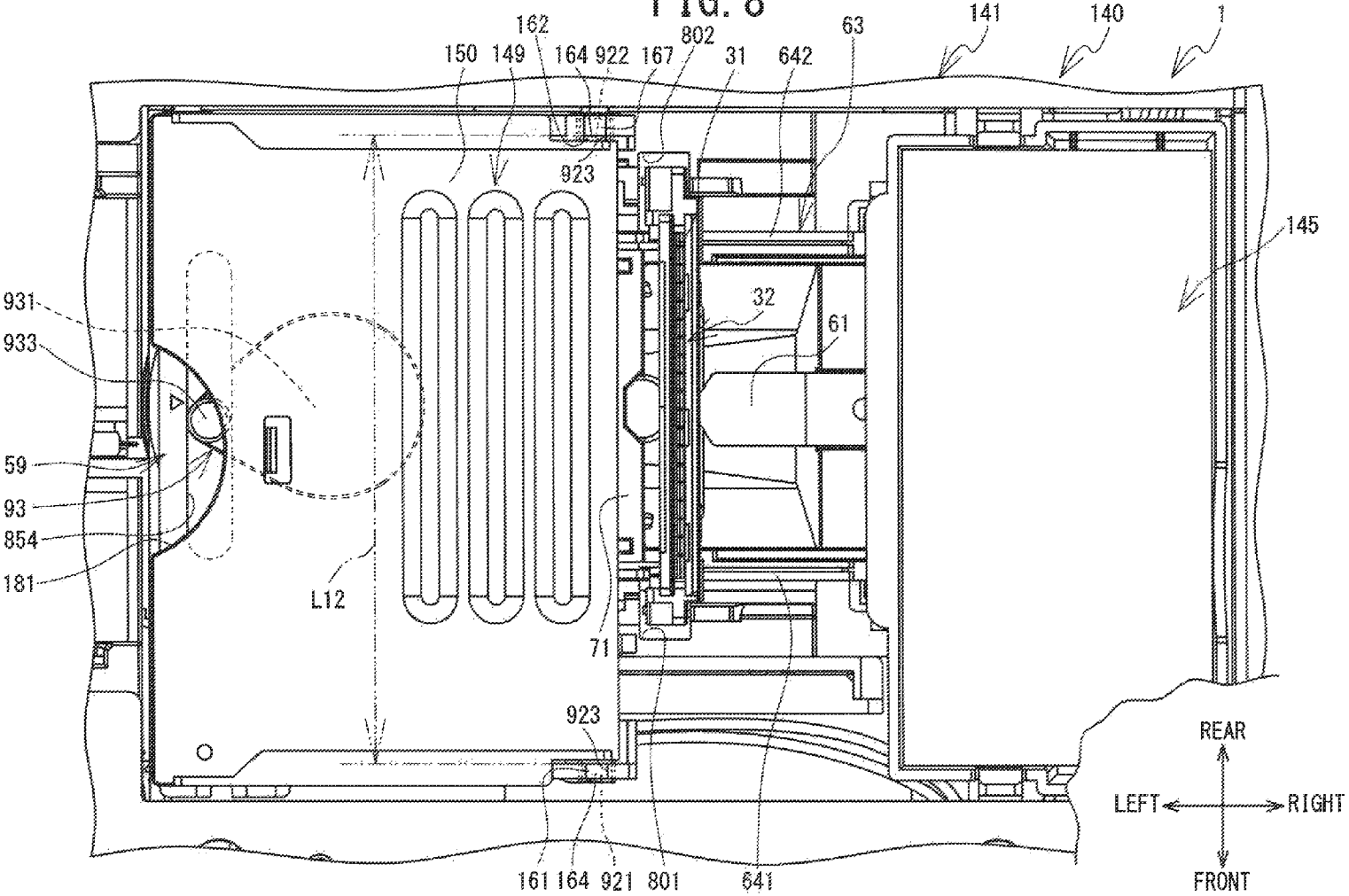
FIG. 8 is a plan view of the maintenance mechanism, with the maintenance member mounted.

As shown in FIGS. 5 and 8, the engagement slots 921, 922 are disposed in the right end portions of the side walls 861, 862, respectively. The engagement slots 921, 922 pass through the side walls 861, 862, respectively, in the front-rear direction. The openings 923 in the engagement slots 921, 922 are open upward, on the side toward the head 110. As shown in FIG. 14, the engagement slots 921, 922 are circular in a side view, for example. The upper edges of the engagement slots 921, 922 are the openings 923, which are open upward. As shown in FIG. 8, when the maintenance member 149 has been mounted on the mounting portion 85, the engagement lugs 161, 162 are disposed inside the engagement slots 921, 922, respectively. The engagement slots 921, 922 do not necessarily have to extend through the side walls 861, 862, as long as the engagement lugs 161, 162 can be disposed inside the engagement slots 921, 922.

The mounting portion 85 moves in the left-right direction in conjunction with the rotation of the rotating member 93. As shown in FIGS. 4 and 5, the rotating member 93 is disposed below the first wall portion 851, the second wall portion 852, and the third wall portion 853 of the mounting portion 85. The rotating member 93 is provided with a rotating wall portion 931, a drive shaft 932 (refer to FIG. 4), and the shaft portion 933. The rotating wall portion 931 is a wall portion that is substantially circular in a plan view. The drive shaft 932 extends in the up-down direction, and its upper end is connected to the center of the bottom face of the rotating wall portion 931. The drive shaft 932 is connected to the drive portion (not shown in the drawings), which includes a motor, a gear, and the like. The drive shaft 932 rotates the rotating wall portion 931 by rotating in conjunction with the operation of the drive portion.

The shaft portion 933 extends in the up-down direction, and its lower end is connected to the outer circumferential portion of the top face of the rotating wall portion 931. The shaft portion 933 is positioned to the outside of the rotational center of the drive shaft 932 and is inserted through the oblong hole 854.

Structure of a Protection Case 400

In a state in which the maintenance member 149 is secured inside a protection case 400, the maintenance member 149 is provided with a protection plate 410. As shown in FIGS. 15 to 19, the protection case 400 is a case that contains the maintenance member 149 and protects the absorption member 51. Hereinafter, the left, right, upper left, lower right, upper right, and lower left sides in FIG. 15 will be called the front, rear, up, down, right, and left sides of the protection case 400. The protection case 400 is a substantially rectangular box in which an opening 401 is open to the front side. The protection case 400 may be formed from a resin material, for example. The protection case 400 is provided with the protection plate 410, a bottom plate 420, a left side wall 430, a right side wall 440, and a rear wall 450 (refer to FIG. 17).

Figure 16:
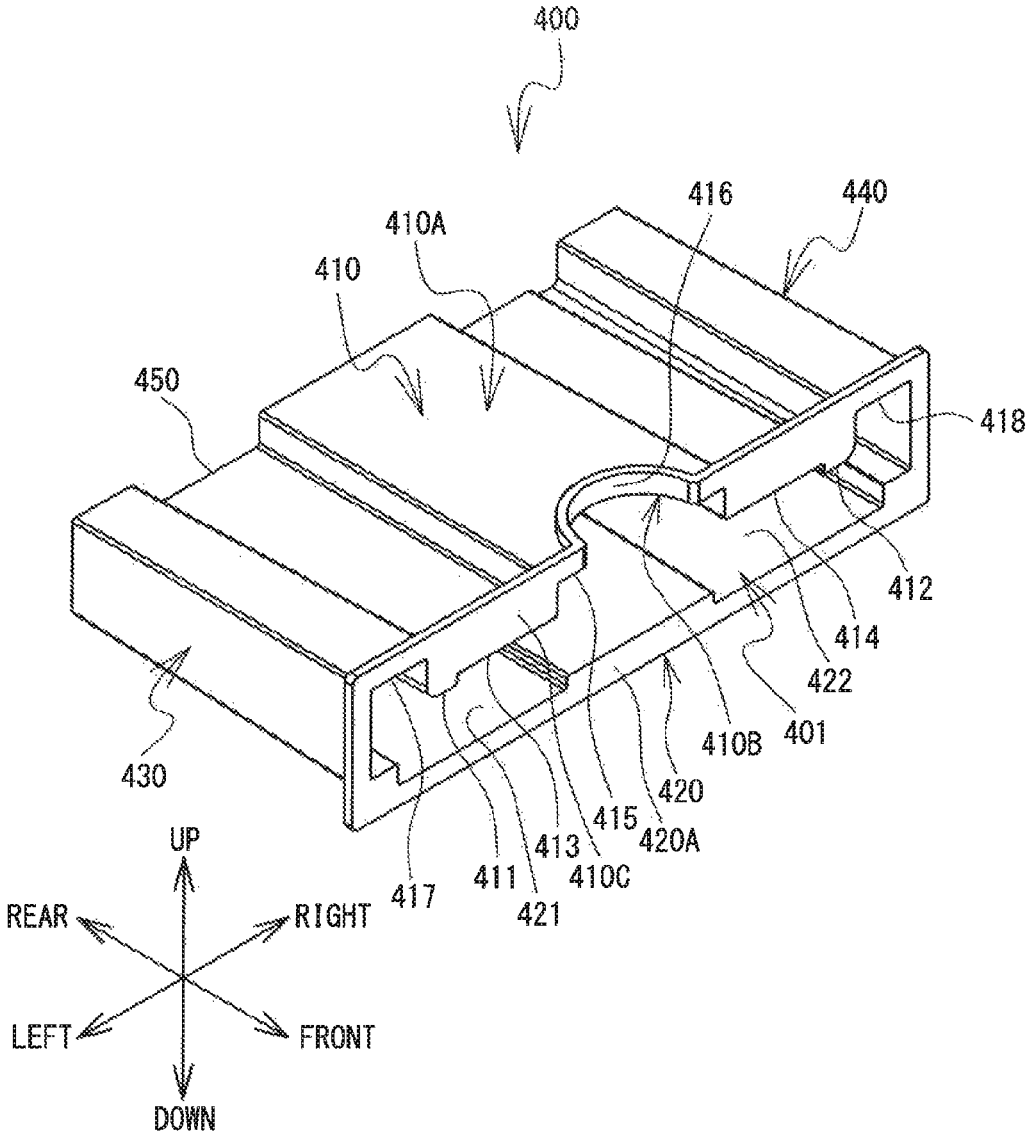
FIG. 16 is an oblique view of the protection case, as seen obliquely from the front and above.
Figure 20:
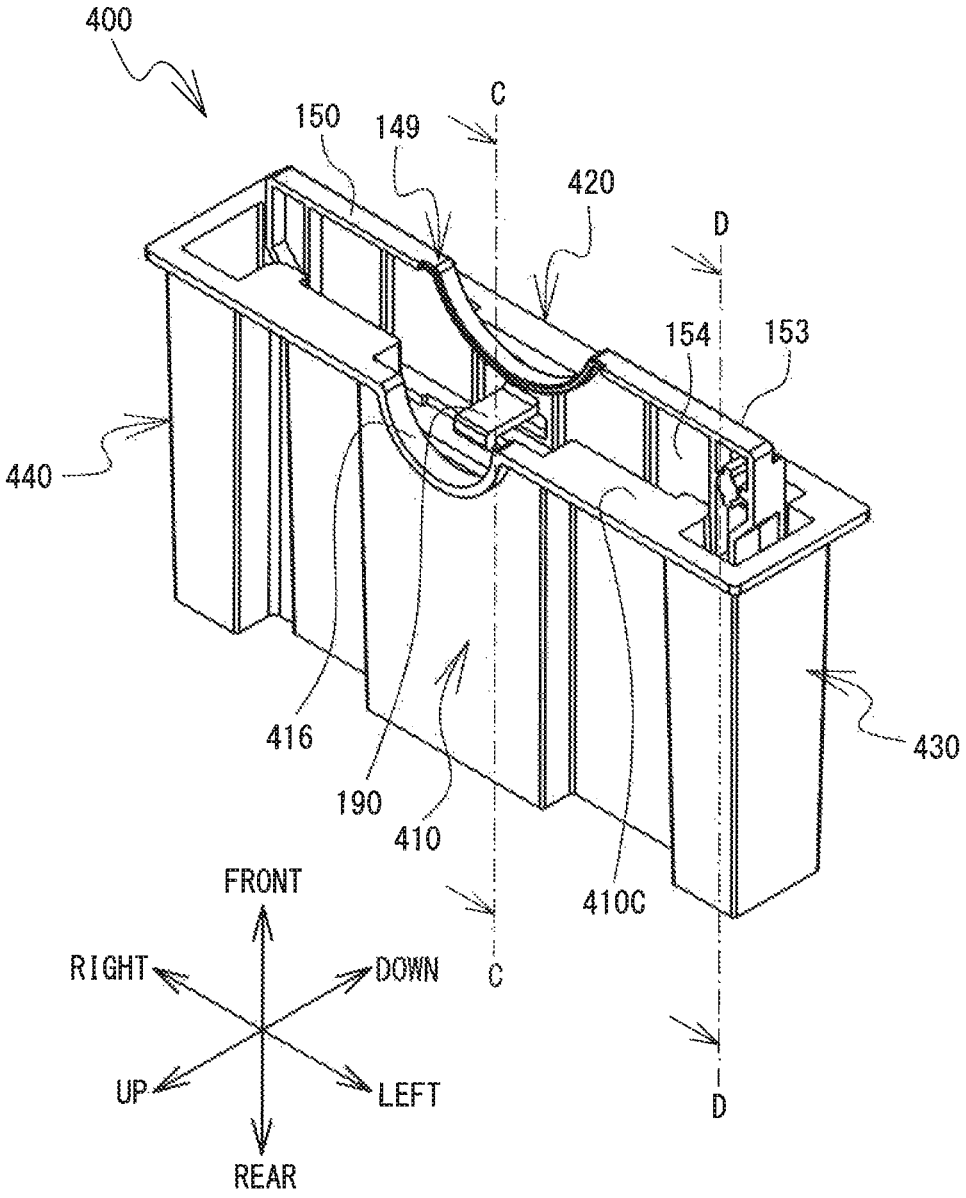
FIG. 20 is an oblique view of a state in which the maintenance member is stored correctly in the protection case.

As shown in FIG. 16, the protection plate 410 is substantially rectangular in a plan view and is provided with a top face 410A, a protection face 410B, and a front edge portion 410C. The top face 410A is the face on the top side of the protection plate 410, and it has raised and recessed portions. The protection face 410B is the face on the bottom side of the protection plate 410. As shown in FIG. 20, when the maintenance member 149 is stored correctly in the protection case 400, the protection face 410B faces the absorption face 202 of the absorption member 51.

Figure 15:
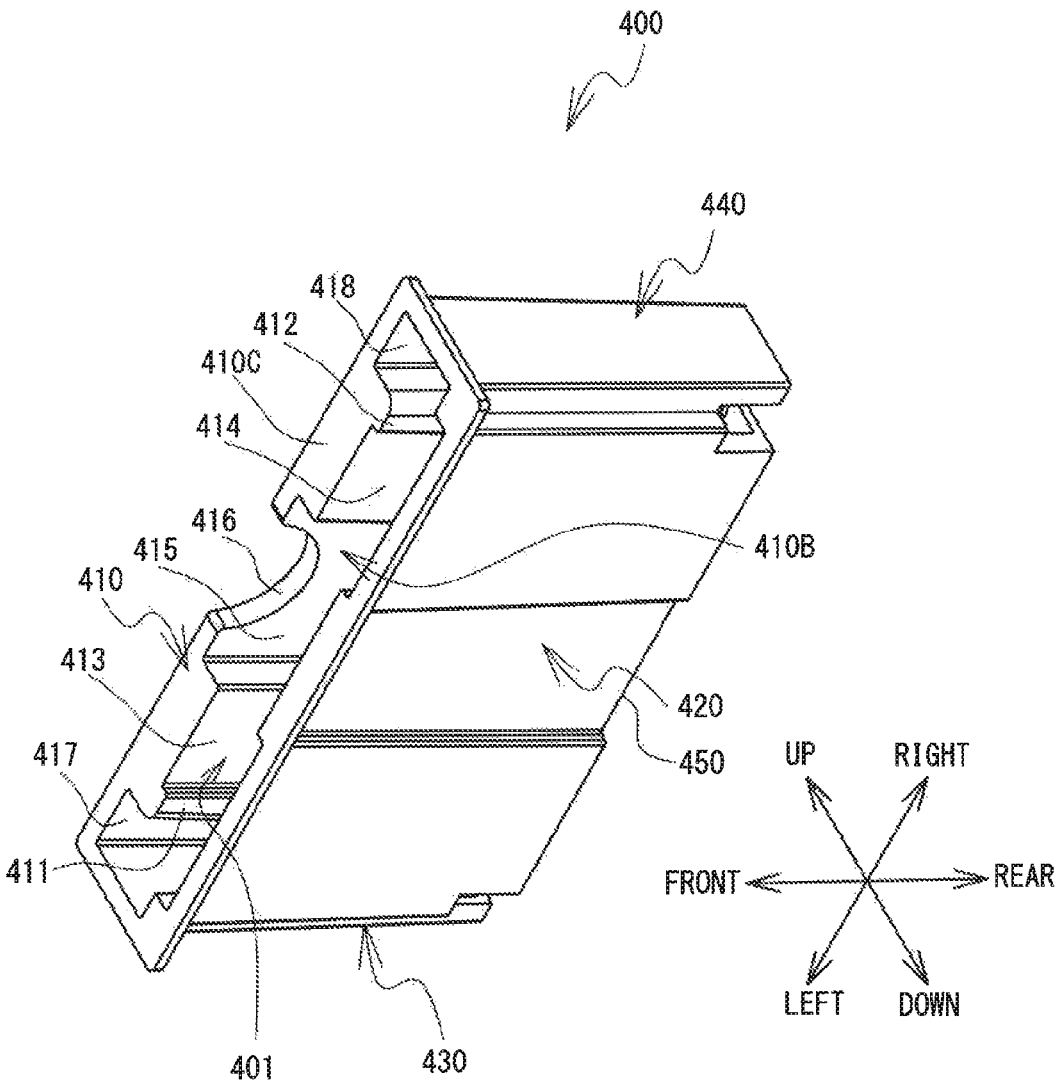
FIG. 15 is an oblique view of a protection case, as seen obliquely from the front and below.
Figure 18:
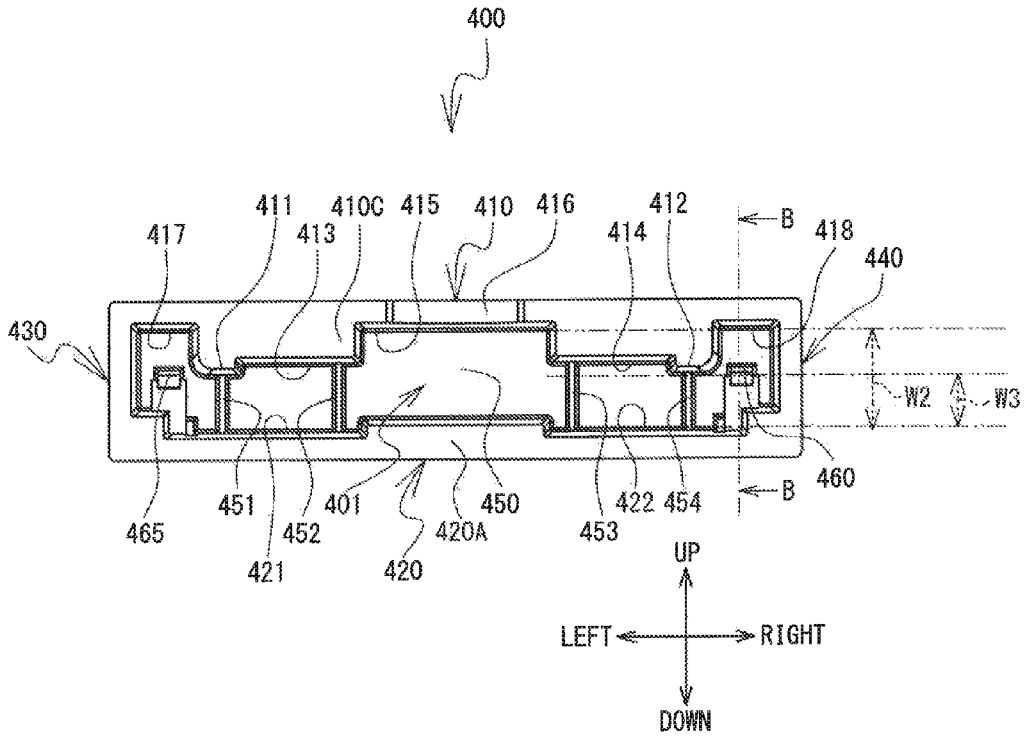
FIG. 18 is a front view of the protection case.

As shown in FIGS. 15, 16, and 18, first opposite projection portions 411, 412, first recessed portions 413, 414, a second recessed portion 415, and third recessed portions 417, 418 are disposed in the protection face 410B of the protection plate 410. Hereinafter, a state in which the maintenance member 149 has been inserted correctly into the protection case 400, as shown in FIG. 20, will be explained. The first opposite projection portions 411, 412 are a left-right pair. The first opposite projection portions 411, 412 reside in positions where they are respectively opposite the first projection portions 151B, 152B (refer to FIG. 11). The first projection portions 151B, 152B are respectively the lower edges of the side walls 151, 152 of the maintenance member 149. The first opposite projection portions 411, 412 are the parts that project farthest downward from the protection face 410B. The bottom faces of the first opposite projection portions 411, 412 extend parallel to the front-rear direction of the protection plate 410 from the front edge portion 410C to the rear wall 450.

The first recessed portions 413, 414 are a left-right pair that are located between the first opposite projection portions 411, 412. The bottom faces of the first recessed portions 413, 414 are recessed upward such that they are higher than the first opposite projection portions 411, 412. The bottom faces of the first recessed portions 413, 414 extend parallel to the front-rear direction of the protection plate 410 from the front edge portion 410C to the rear wall 450. The second recessed portion 415 is located between the first recessed portions 413, 414. The bottom face of the second recessed portion 415 is recessed upward such that it is higher than the bottom faces of the first recessed portions 413, 414. The bottom face of the second recessed portion 415 extends parallel to the front-rear direction of the protection plate 410 from the front edge portion 410C to the rear wall 450.

The third recessed portions 417, 418 are located to the outside of the first opposite projection portions 411, 412 on the left and right, respectively. The expression "to the outside on the left and right" means in the leftward direction and the rightward direction from the center in the left-right direction of the protection plate 410. The expression "to the inside on the left and right" would mean toward the center in the left-right direction of the protection plate 410. The bottom faces of the third recessed portions 417, 418 are recessed upward such that they are higher than the first opposite projection portions 411, 412. The bottom faces of the third recessed portions 417, 418 extend parallel to the front-rear direction of the protection plate 410 from the front edge portion 410C to the rear wall 450. The bottom faces of the third recessed portions 417, 418 are recessed upward such that they are higher than the bottom faces of the first recessed portions 413, 414.

A recessed portion 416 that is recessed toward the rear is located in the front edge portion 410C of the protection plate 410. The recessed portion 416 is recessed such that the locking projection portion 190 of the maintenance member 149 will not come into contact with the front edge portion 410C.

Figure 17:
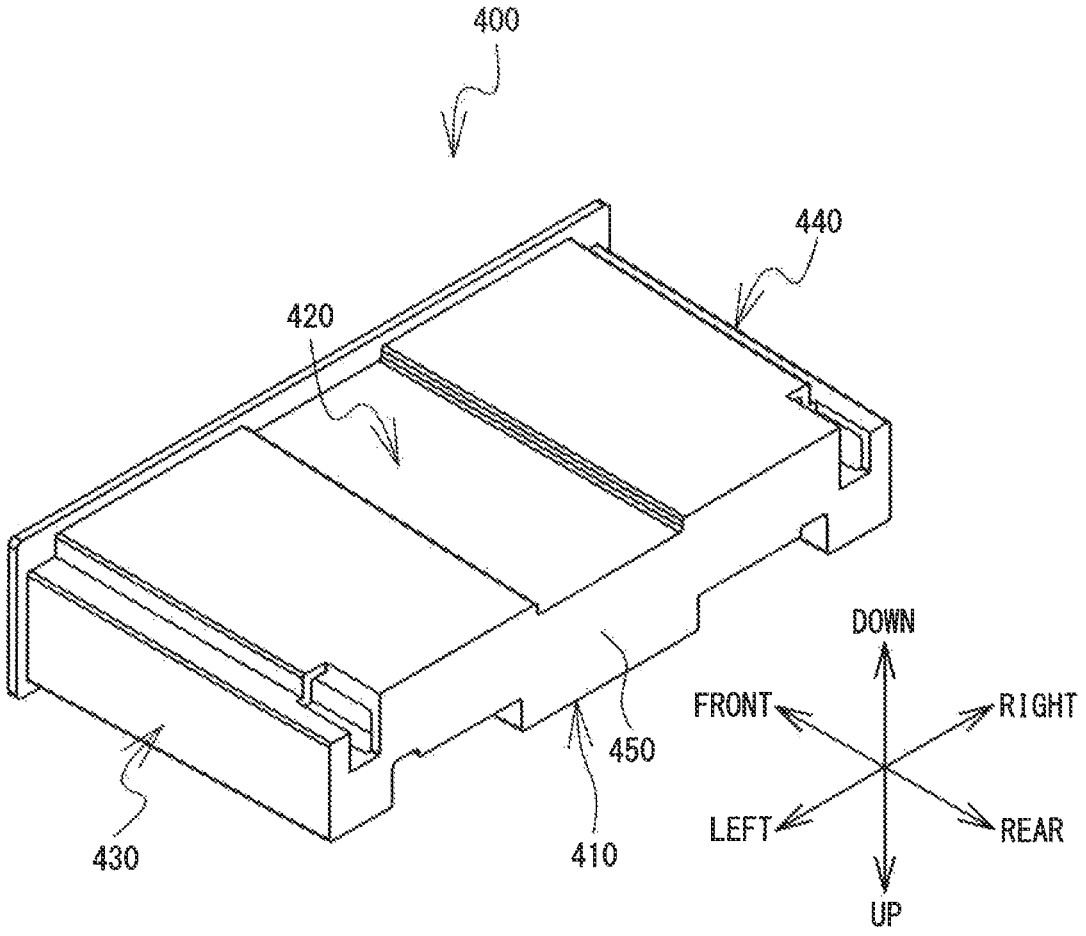
FIG. 17 is an oblique view of the protection case, as seen obliquely from the rear and above.
Figure 19:
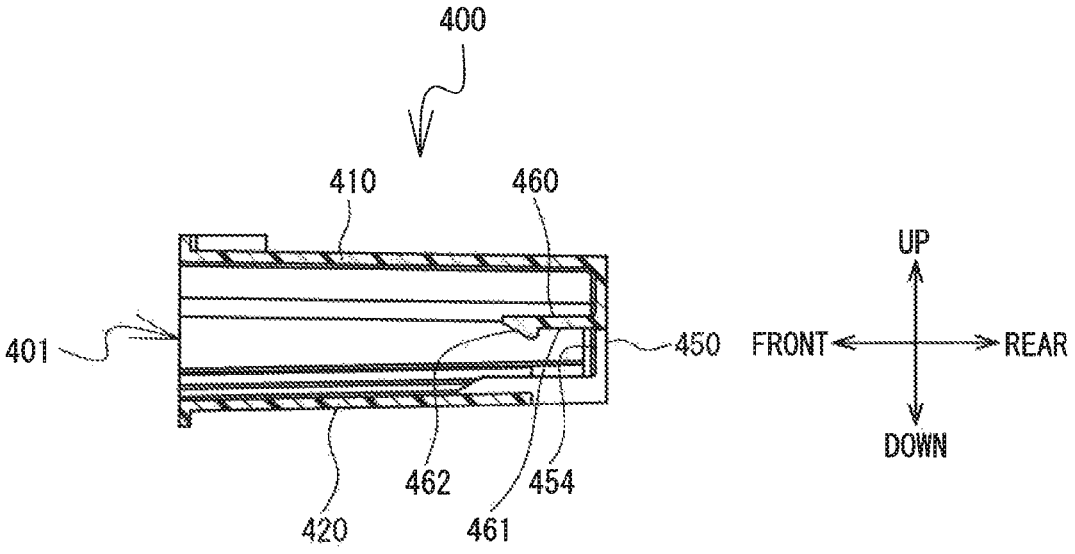
FIG. 19 is a section view of the protection case, as seen from the direction of arrows B-B in FIG. 18.

As shown in FIG. 17, the bottom plate 420 is substantially rectangular in a plan view. As shown in FIG. 18, the bottom plate 420 is provided with a front edge portion 420A. The protection case 400 is provided with the rear wall 450, which extends from the protection plate 410 to the bottom plate 420. As shown in FIGS. 18 and 19, the rear wall 450 is provided with a left-right pair of engaged portions 460, 465. The engaged portions 460, 465 project from the rear wall 450 toward the front of the protection plate 410. The engaged portions 460, 465 are configured to flex in an extension direction of the rear wall 450. As shown in FIG. 19, the engaged portion 460 is provided with a plate portion 461 that extends toward the front by a specified distance. A locked claw 462 is located on the tip of the plate portion 461. The engaged portion 465 has the same structure. The engaging of the locked claw 462 with the engagement lug 162 of the maintenance member 149 allows the protection case 400 to secure the maintenance member 149 such that the maintenance member 149 can be inserted and removed. The locked claw 462 of the engaged portion 465 engages with the engagement lug 161 in the same manner. As shown in FIG. 18, the engaged portions 465, 460 are located to the outside of the first opposite projection portions 411, 412 on the left and right, respectively.

Figure 21:
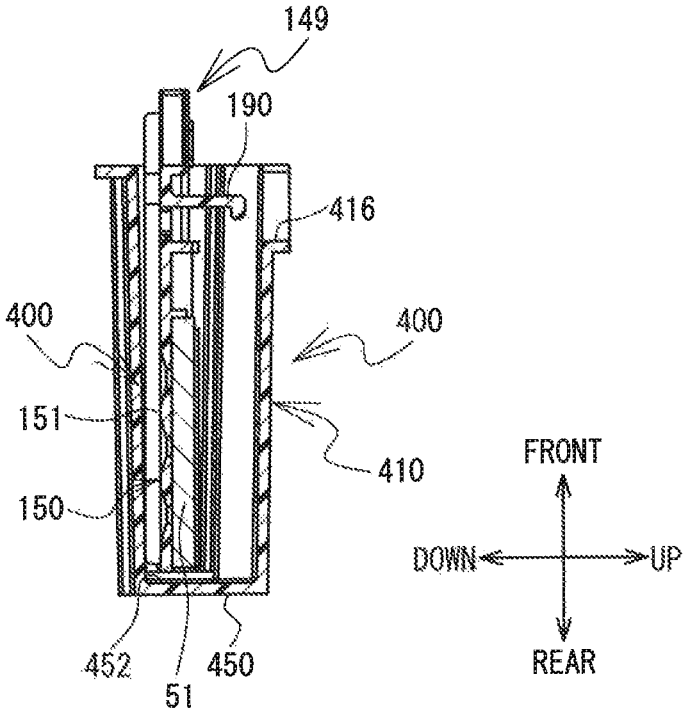
FIG. 21 is a section view of the protection case and the maintenance member, as seen from the direction of arrows C-C in FIG. 20.

As shown in FIG. 18, the rear wall 450 is provided with ribs 451, 452, 453, 454. The ribs 451, 452, 453, 454 are provided such that they project toward the front from the rear wall 450 and extend in the up-down direction. As shown in FIG. 21, when the maintenance member 149 has been stored in the protection case 400, the right edge 150A of the upper plate 150 of the maintenance member 149 is in contact with the ribs 451, 452, 453, 454.

As shown in FIGS. 16 and 18, the bottom plate 420 is provided with a left-right pair of fourth recessed portions 421, 422. The top faces of the fourth recessed portions 421, 422 are recessed downward. The top faces of the fourth recessed portions 421, 422 extend parallel to the front-rear direction of the protection plate 410 from the front edge portion 420A to the rear wall 450. In a state in which the maintenance member 149 is stored in the protection case 400, the fourth recessed portions 421, 422 face upward toward the third projection portions 151A, 152A, respectively. The distance between the left edge of the fourth recessed portion 421 and the right edge of the fourth recessed portion 422 is greater than the distance between the third projection portions 151A, 152A.

The Storing of the Maintenance Member 149 in the Protection Case 400

A case in which the maintenance member 149 is stored correctly in the protection case 400, as shown in FIG. 20, will be explained. When the maintenance member 149 is stored in the protection case 400, the maintenance member 149 that is shown in FIG. 11 is inserted into the opening 401 of the protection case 400 that is shown in FIG. 16, starting from the right edge 150A of the upper plate 150. In this process, the maintenance member 149 is inserted into the opening 401 such that the protection face 410B of the protection plate 410 is opposite the lower face 154 of the upper plate 150. In this state, the locking projection portion 190 of the maintenance member 149 enters the recessed portion 416 of the protection case 400. Therefore, the locking projection portion 190 does not come into contact with the front edge portion 410C of the protection plate 410.

Figure 22:
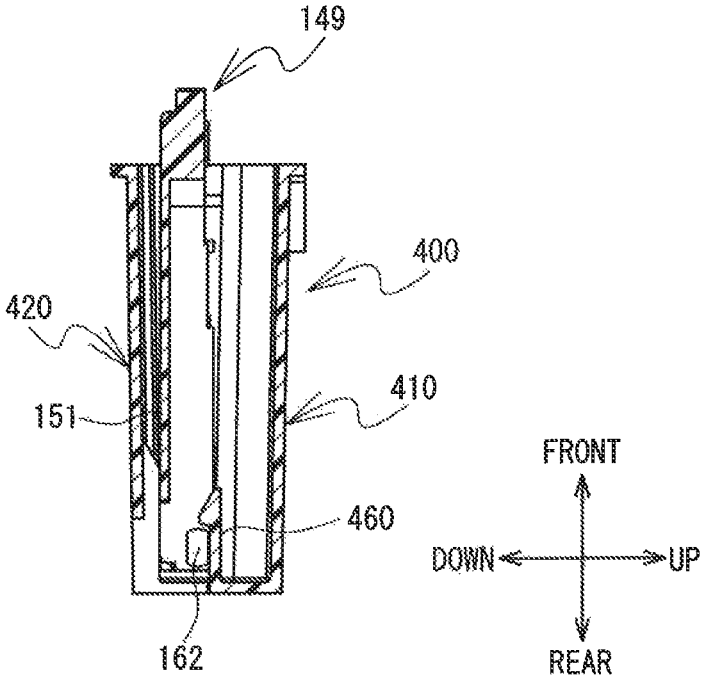
FIG. 22 is a section view of the protection case and the maintenance member, as seen from the direction of arrows D-D in FIG. 20.

Therefore, as shown in FIG. 21, the maintenance member 149 is inserted into the protection case 400 until the edge of the maintenance member 149 comes into contact with the ribs 451, 452, 453, 454 (refer to FIG. 18). At this time, the engagement lug 162 of the maintenance member 149 engages with the engaged portion 460, as shown in FIG. 22. The engagement lug 161 engages with the engaged portion 465 in the same manner. The protection case 400 thus secures the maintenance member 149 in its stored state.

In this state, the first opposite projection portions 411, 412 of the protection plate 410 (refer to FIG. 15) are respectively positioned opposite the first projection portions 151B, 152B of the maintenance member 149 (refer to FIG. 11). The absorption face 202 of the absorption member 51 (refer to FIG. 11) is positioned opposite the first recessed portions 413, 414 and the second recessed portion 415 (refer to FIG. 15). As shown in FIG. 11, the first projection portions 151B, 152B project farther than the absorption face 202 of the absorption member 51 in the up-down direction. Therefore, when the operator presses the protection plate 410 of the protection case 400 downward, the first opposite projection portions 411, 412 come into contact with the first projection portions 151B, 152B of the maintenance member 149 before the protection face 410B comes into contact with the absorption member 51. In this state of contact, a space is formed between the protection face 410B and the absorption face 202 of the absorption member 51. It is therefore possible to prevent the protection face 410B from pressing on the absorption member 51. The possibility that liquid will seep out of the absorption member 51 may thus be decreased.

Figure 23:
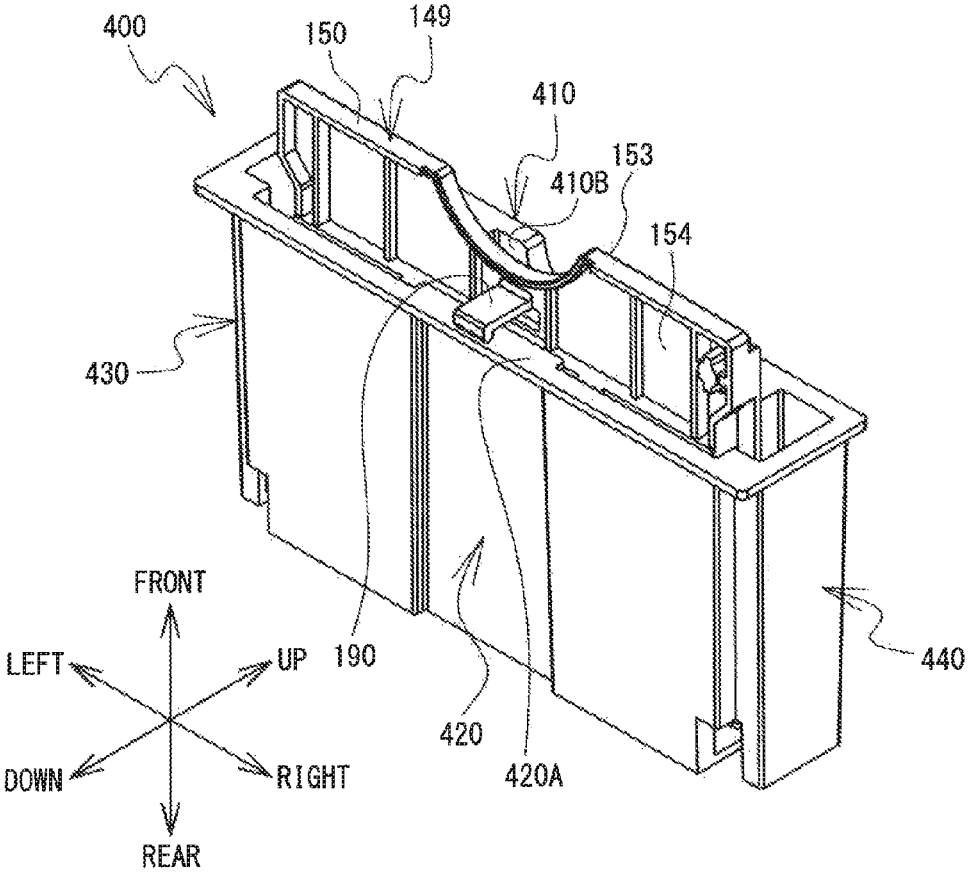
FIG. 23 is an oblique view of a state in which the maintenance member is housed in the protection case with the orientations of an upper face and a lower face reversed.

A case in which the maintenance member 149 is not stored correctly in the protection case 400, as shown in FIGS. 13, 18, and 23, will be explained. The maintenance member 149 is inserted into the protection case 400 such that the protection face 410B of the protection plate 410 is opposite the upper face 153 of the upper plate 150. In this state, the lower face 154 of the maintenance member 149 faces the bottom plate 420. The locking projection portion 190 is on the lower face 154, but the bottom plate 420 does not have a recessed portion to avoid contact with the locking projection portion 190. Therefore, the locking projection portion 190 comes into contact with the front edge portion 420A of the bottom plate 420. In this situation, the maintenance member 149 cannot be inserted far enough into the protection case 400 to come into contact with the ribs 451, 452, 453, 454. The engagement lug 162 of the maintenance member 149 cannot engage with the engaged portion 460. In the same manner, the engagement lug 161 cannot engage with the engaged portion 465. The maintenance member 149 thus enters a state in which it is positioned farther toward the front than when it is in the correct state that is shown in FIG. 20. In this position, the maintenance member 149 is not be secured in the protection case 400. Therefore, it may be easy for the operator to notice that the maintenance member 149 is not stored correctly in the protection case 400. A distance W1 (refer to FIG. 13), for example, needs only to be not less than a distance W3 (refer to FIG. 18), for example. The distance W1 is the distance from the third projection portions 151A, 152A of the upper plate 150 to the locking projection portion 190. The distance W3 is the distance from the lower faces of the first opposite projection portions 411, 412 to the upper faces of the fourth recessed portions 421, 422, respectively. A distance W2 (refer to FIG. 18) needs only to be not less than the distance W1, for example. The distance W2 is the distance from the lower face of the second recessed portion 415 to the upper faces of the fourth recessed portions 421, 422. For example, the condition that $W3 \leq W1 \leq W2$ needs to be satisfied.

Because the protection plate 410 is fixed in place with a gap between it and the absorption member 51, the protection plate 410 protects the absorption member 51. When external pressure bears on the protection plate 410, for example, the protection face 410B can be prevented from pressing on the absorption member 51. Therefore, the possibility that liquid will seep out of the absorption member 51 may be decreased.

The space between the pair of the first opposite projection portions 411, 412 is recessed upward higher than the first opposite projection portions 411, 412. This recessed area is formed by the first recessed portions 413, 414 and the second recessed portion 415, for example. The maintenance member 149 is oriented such that the absorption member 51 is opposite this recessed area. When external pressure bears on the protection plate 410, for example, the contact that is made between the first opposite projection portions 411, 412 and the first projection portions 151B, 152B, respectively, inhibits the external pressure from bearing on the absorption member 51. Therefore, the possibility that liquid will seep out of the absorption member 51 may be decreased.

The engagement lugs 161, 162 of the upper plate 150 respectively engage with the engaged portions 465, 460 of the protection plate 410. This structure may protect the absorption member 51 by decreasing the possibility that the upper plate 150 of the maintenance member 149 will move away from the protection plate 410 when the protection case 400 is dropped, for example. The engaged portions 460, 465 flex in the extension direction of the rear wall 450. Therefore, the engagement lugs 161, 162 of the upper plate 150 may engage easily with the engaged portions 465, 460 of the protection plate 410 by the force that acts on the maintenance member 149 when the maintenance member 149 is inserted into the protection case 400.

The engaged portions 460, 465 are located to the outside of the first opposite projection portions 411, 412. Therefore, the distance between the engaged portion 460 and the engaged portion 465 is greater than it would be if the engaged portions 460, 465 were located to the inside of the first opposite projection portions 411, 412. Because the engaged portions 460, 465 are separated by a substantial distance, they may hold the upper plate 150 of the maintenance member 149 in a stable manner.

The third recessed portions 417, 418 are located in the protection plate 410 to the outside of the first opposite projection portions 411, 412, respectively, and are recessed upward higher than the first opposite projection portions 411, 412. This structure may ensure a greater range of flexure for the engaged portions 460, 465.

The ribs 451, 452, 453, 454 are configured to ensure a distance between the rear wall 450 and the right edge 150A of the upper plate 150. This structure may make it possible for the engaged portions 460, 465 to be made longer in the direction in which the protection face 410B extends. The force that flexes the engaged portions 460, 465 thus becomes less than it would be if the engaged portions 460, 465 were shorter. Therefore, it may be easy for the engagement lugs 161, 162 of the upper plate 150 to engage with and disengage from the engaged portions 465, 460 of the protection plate 410.

The length L6 in the left-right direction of the engagement lugs 161, 162 is greater than the length L7 in the up-down direction of the engagement lugs 161, 162. Therefore, the maintenance member 149 may be mounted in and removed from the device by rotating the maintenance member 149.

In the state in which the first projection portions 151B, 152B and the first opposite projection portions 411, 412 are respectively opposite one another, the locking projection portion 190 does not come into contact with the protection plate 410. The maintenance member 149 may therefore fit into the protection case 400. In the state in which the first projection portions 151B, 152B and the first opposite projection portions 411, 412 are disposed on opposite sides of the upper plate 150, the locking projection portion 190 does come into contact with the bottom plate 420. Therefore, the maintenance member 149 cannot fit into the protection case 400. The maintenance member 149 cannot fit into the protection case 400 when the upper plate 150 is not in the correct orientation. Therefore, the operator may be prevented from fitting the maintenance member 149 into the protection case 400 incorrectly.

The bottom plate 420 is recessed across a wider span than the distance between the third projection portions 151A, 152A. Because the bottom plate 420 is recessed across a wide span, it may accommodate the third projection portions 151A, 152A. The maintenance member 149 may therefore fit into the protection case 400.

Figure 24:
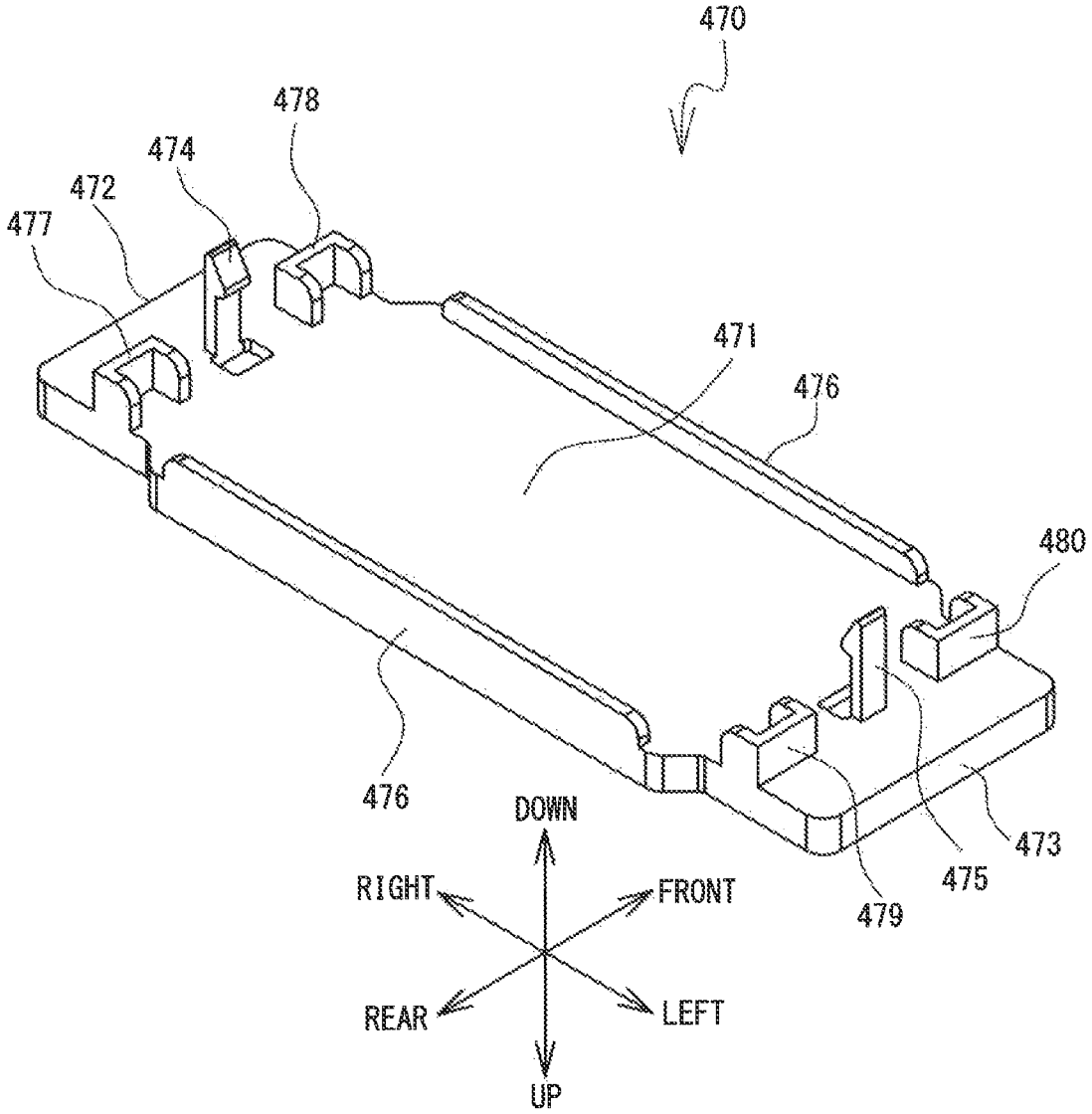
FIG. 24 is an oblique view of a protection plate in a modified example.

The disclosure is not limited to the embodiment that is described above, and various types of modifications can be made. For example, the structure that protects the absorption member 51 is not limited to a box-shaped object like the protection case 400, and it may also be a plate-shaped protection plate 470, as shown in FIG. 24. The protection plate 470 is substantially rectangular in a plan view, and it is provided with a protection face 471, a pair of wall portions 476, 476, a pair of engagement portions 474, 475, and lugs 477 to 480. The protection face 471 is a flat surface that is substantially rectangular in a plan view. The wall portions 476, 476 have specified heights and extend along the front and rear edges of the protection face 471. The wall portions 476, 476 extend in the left-right direction. The lugs 477 to 480 have specified heights and are provided at the left and right ends of the protection face 471. The engagement portions 474, 475 rise vertically from the right and left ends, respectively, of the protection face 471. The protection plate 470 is fixed in place such that the protection face 471 faces the absorption face 202 of the absorption member 51 of the maintenance member 149 that is shown in FIG. 11. The engagement portions 474, 475 engage with the side walls 151, 152 of the upper plate 150. The lugs 477, 478, 479, 480 form a space between the protection face 471 and the absorption face 202 of the absorption member 51. The wall portions 476, 476 protect the edge face 201 of the absorption member 51 and the edge face of the absorption member 51 on the opposite side from the edge face 201.

In the embodiment that is described above, the protection plate 410 is provided with the first recessed portions 413, 414 and the second recessed portion 415, but the first recessed portions 413, 414 and the second recessed portion 415 may also be a single recessed portion. In the embodiment that is described above, the engaged portions 460, 465 are provided on the rear wall 450, but the engaged portions 460, 465 may instead be provided on the right side wall 440 and the left side wall 430, respectively. In that case, the rear wall 450 may be omitted from the protection case 400. It is also acceptable for the upper plate 150 not to be provided with the first projection portions 151B, 152B. It is also acceptable for the upper plate 150 not to be provided with the third projection portions 151A, 152A. In that case, it is also acceptable for the bottom plate 420 not to be provided with the fourth recessed portions 421, 422. It is also acceptable for the protection plate 410 not to be provided with the first opposite projection portions 411, 412 in positions that are opposite the first projection portions 151B, 152B. The upper plate 150 may also be provided with one each of the first projection portion and the first opposite projection portion. It is also acceptable for the upper plate 150 not to be provided with the locking projection portion 190. It is also acceptable for the upper plate 150 not to be provided with the engagement lugs 161, 162. In that case, the upper plate 150 may be held by an engagement portion that is provided in the housing 2. It is also acceptable for only one of the engaged portions 460, 465 to be provided on the rear wall 450. The rear wall 450 may also be provided with any number of ribs, such as one, two, three, or the like.

Figure 25:
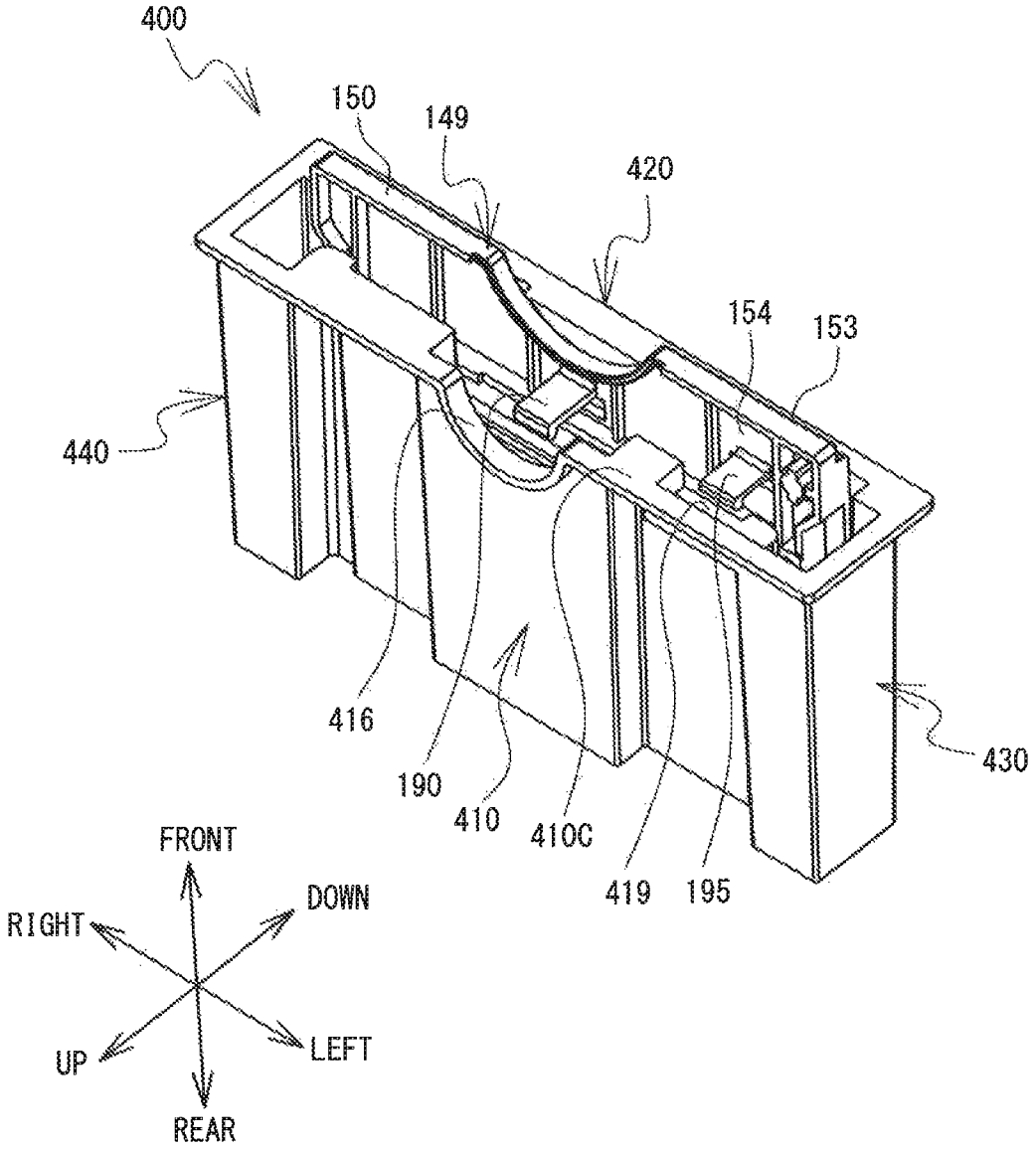
FIG. 25 is an oblique view of a state in which the maintenance member is stored correctly in the protection case in a modified example.

For example, the structures of the maintenance member 149 and the protection case 400 are not limited to those in the embodiment that is described above. The modified example that is shown in FIG. 25 differs from the embodiment that is described above (refer to FIG. 20) in the points described below. The maintenance member 149 in the modified example is provided with a locking projection portion 195 that is disposed to the left of the locking projection portion 190 and closer to the front. The locking projection portion 195 is the same sort of projection portion as the locking projection portion 190, being provided with a plate portion and a locking claw. In the same manner as the locking claw 192 of the locking projection portion 190, the locking claw of the locking projection portion 195 locks to a locking portion that is not shown in the drawings. The protection case 400 in the modified example is provided with a recessed portion 419 that is positioned to the left of the recessed portion 416. The recessed portion 419 is a recessed portion that is located in the front edge portion 410C of the protection plate 410 and is recessed toward the rear. The recessed portion 419 is recessed such that the locking projection portion 195 will not come into contact with the front edge portion 410C.

The locking projection portion 195 is provided in order to prevent warping of the upper plate 150. In some cases, the printer 1 is provided with an open-closed switch that detects whether the maintenance member 149 is in the mounted orientation that is shown in FIG. 7 when the maintenance member 149 has been mounted in the printer 1, for example. In a case where the open-closed switch comes into contact with a column-shaped projection portion that projects upward from the lower face 154 of the upper plate 150, the open-closed switch sends a detection signal to a control portion of the printer 1. Accordingly, a downward force is applied from the open-closed switch to the maintenance member 149 in the mounted orientation. The locking claw of the locking projection portion 195 locks to the locking portion of the printer 1 in order to prevent the upper plate 150 from warping downward due to the downward force.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A maintenance member comprising:

a plate including a first face, the plate being configured to be mounted in a print device, the print device being configured to recover ink adhering to a wiper, the wiper being configured to wipe off ink adhering to a nozzle formation face of a print head, the print head being configured to discharge ink;

an absorption member fixed on the first face and having absorbed a liquid, an edge surface of the absorption member being exposed in an extension direction of the first face; and a protection plate fixed in place such that a gap is provided between the protection plate and the absorption member wherein the plate includes a first projection portion projecting farther than the absorption member on the first face, and the protection plate includes a first opposite projection portion in a position opposite the first projection portion.

2. The maintenance member according to claim 1, wherein the protection plate includes a pair of the first opposite projection portions, with a space between the pair of the first opposite projection portions, the space being recessed in relation to the pair of the first opposite projection portions.

3. The maintenance member according to claim 1, wherein the plate includes an engagement portion projecting in an orthogonal direction orthogonal to the extension direction of the first face in the first face, the protection plate includes a protection face and a wall, the protection face opposing the absorption member, the wall extending from the protection face in a direction crossing the protection face, the wall includes an engaged portion, the engaged portion projecting in an extension direction of the protection face and being configured to engage with the engagement portion, and the engaged portion is configured to engage with the engagement portion by flexing in an extension direction of the wall.

4. The maintenance member according to claim 3, wherein the plate includes a first projection portion projecting farther than the absorption member on the first face, the protection plate includes a first opposite projection portion in a position opposite the first projection portion, and the engaged portion is disposed to the outside from the first opposite projection portion.

5. The maintenance member according to claim 4, wherein the area to the outside from the first opposite projection portion is recessed in relation to the first opposite projection portion.

6. The maintenance member according to claim 3, wherein the wall includes a pair of the engaged portions, and the wall includes at least one rib between the pair of the engaged portions.

7. The maintenance member according to claim 3, wherein the length of the engagement portion in the extension direction of the first face is greater than the length of the engagement portion in a thickness direction of the engagement portion, the thickness direction of the engagement portion being orthogonal to the extension direction of the first face and to the orthogonal direction.

8. The maintenance member according to claim 2, wherein the protection plate includes a bottom plate disposed such that a gap is provided between the protection plate and the bottom plate, the plate includes a pair of the first projection portions and a second projection portion, the second projection portion being disposed between the pair of the first projection portions, the second projection portion projecting in the same direction as the pair of the first projection portions, the second projection portion does not come into contact with the protection plate in a state in which the pair of the first opposite projection portions oppose the pair of the first projection portions, and the second projection portion comes into contact with the bottom plate in a state in which the pair of the first opposite projection portions and the pair of the first projection portions are on opposite sides of the plate.

9. The maintenance member according to claim 8, wherein the plate includes a pair of third projection portions projecting from the second face of the plate, and the bottom plate is recessed across a wider space than the space between the pair of the third projection portions.

10. A maintenance member comprising:

a plate including a first face and a second face disposed on the opposite side from the first face;

an absorption member configured to absorb ink, the absorption member including an opposite face and an exposed face, the opposite face opposing the first face, the exposed face being disposed on the opposite side from the opposite face, the absorption member being disposed on the first face and having absorbed a liquid;

a plate edge located in a thickness direction from the exposed face, the thickness direction being the direction from the first face toward the second face, the plate edge being an edge of the plate on the side of the plate in an extension direction of the first face;

opening edge portions located in the plate and opening toward the absorption member from the second face; and a protection plate fixed in place such that a gap is provided between the protection plate and the absorption member wherein the plate includes a first projection portion projecting farther than the absorption member on the first face, and the protection plate includes a first opposite projection portion in a position opposite the first projection portion.

* * * * *